US012376654B2

(12) United States Patent
Siegismund

(10) Patent No.: US 12,376,654 B2
(45) Date of Patent: Aug. 5, 2025

(54) FASTENING SYSTEM FOR AN ARTICLE

(71) Applicant: PUMA SE, Herzogenaurach (DE)

(72) Inventor: Andreas Siegismund, Rueckersdorf (DE)

(73) Assignee: PUMA SE, Herzogenaurach (DE)

( * ) Notice: Subject to any disclaimer, the term of this patent is extended or adjusted under 35 U.S.C. 154(b) by 217 days.

(21) Appl. No.: 18/198,102

(22) Filed: May 16, 2023

(65) Prior Publication Data

US 2023/0363497 A1 Nov. 16, 2023

Related U.S. Application Data

(60) Provisional application No. 63/342,289, filed on May 16, 2022.

(51) Int. Cl.
*A43C 11/20* (2006.01)
*A43C 11/16* (2006.01)

(52) U.S. Cl.
CPC ..... *A43C 11/20* (2013.01); *A43C 11/16* (2013.01)

(58) Field of Classification Search
CPC ..... Y10T 24/45628; Y10T 24/45639; Y10T 24/45644; Y10T 24/45649; Y10T 24/45675; Y10T 24/45696; Y10T 24/45702; Y10T 24/45613; Y10T 24/45618; Y10T 24/4589; Y10T 24/45958
See application file for complete search history.

(56) References Cited

U.S. PATENT DOCUMENTS

| | | | | | |
|---|---|---|---|---|---|
| 479,995 | A * | 8/1892 | Stacey | A44B 11/2526 | 24/647 |
| 1,133,479 | A * | 3/1915 | Kosel | A44B 11/2511 | 24/631 |
| 1,211,996 | A * | 1/1917 | Wright | A01K 73/06 | 24/697.2 |
| 1,409,327 | A * | 3/1922 | Wiltein | A43C 7/00 | 24/712 |
| 8,061,061 | B1 * | 11/2011 | Rivas | A43C 11/165 | 36/137 |
| 2022/0079293 | A1 * | 3/2022 | Houng | A43B 23/0235 | |

* cited by examiner

*Primary Examiner* — Khoa D Huynh
*Assistant Examiner* — Akwokwo Olabisi Redhead
(74) *Attorney, Agent, or Firm* — Quarles & Brady LLP

(57) ABSTRACT

A fastening system for an article of footwear includes an upper having inner and outer layers with a fastening mechanism disposed along the inner layer and a plurality of apertures defined along the outer layer. The fastening mechanism includes a fastening member rotatable in first and second directions and a plurality of fastening elements spaced from the fastening member and corresponding with respective apertures. The fastening elements are connected to the fastening member by a connecting element such that, when the fastening member is rotated in the first direction, the fastening elements are simultaneously rotated from a first position toward a second position. The fastening system is moveable between a loosened configuration, in which the fastening elements are in the first position and aligned within respective apertures, and a tightened configuration, in which the fastening elements are in the second position and offset with respect to respective apertures.

20 Claims, 12 Drawing Sheets

FASTENING SYSTEM FOR AN ARTICLE

CROSS REFERENCE TO RELATED APPLICATIONS

This application claims the benefit of priority from U.S. Provisional Application No. 63/342,289, filed on May 16, 2022, and entitled "FASTENING SYSTEM FOR AN ARTICLE," the contents of which is incorporated herein by reference in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to a fastening system for an article, and more specifically to articles having fastening systems that include a fastening member and a plurality of fastening elements.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, a fastening system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

Likewise, other articles, such as articles of clothing, generally comprise a fastening system to open or close a portion of the article of clothing. Conventional articles of clothing, such as, for example, a pair of pants or shorts, may include one or more fly sections along a waistband with an outer flap of the fly section being fastened to an inner flap by one or more of a button and a zipper arranged on one or both of the inner and outer flaps.

While many currently available articles, such as articles of footwear, have varying features related to the above-noted properties, in many cases, articles having fastening systems that are more easily and more quickly tightened or loosened by the user are desired, along with improved aesthetic appeal of any visible portions of such fastening systems.

SUMMARY

An article, as described herein, may have various configurations. For example, an article of footwear may have an upper and a sole structure connected to the upper.

In some embodiments, the present disclosure provides a fastening system for an article of footwear, the fastening system can include an upper that has an inner layer and an outer layer with a fastening mechanism that can be disposed along the inner layer and a plurality of apertures that can be defined along the outer layer. The fastening mechanism can include a fastening member that is rotatable in a first direction and a second direction, opposite the first direction, and a plurality of fastening elements that can be disposed in a line and spaced from the fastening member. The plurality of fastening elements can be operatively connected to the fastening member by a connecting element. Each of the plurality of fastening elements can correspond with a respective aperture of the plurality of apertures. The fastening mechanism is configured such that when the fastening member is rotated in the first direction, each of the plurality of fastening elements are simultaneously rotated from a first position toward a second position. The fastening system is configured to be moveable between a loosened configuration, in which each of the fastening elements is in the first position and aligned within each respective aperture of the plurality of apertures, and a tightened configuration, in which each of the fastening elements is in the second position and offset with respect to each respective aperture of the plurality of apertures.

In some embodiments, the present disclosure provides an article of footwear including a sole attached to an upper that includes a first layer and a second layer and a fastening system. The fastening system includes a plurality of apertures arranged along the first layer and a fastening mechanism. The fastening mechanism includes a fastening member, a plurality of fastening elements, and a connecting element. The fastening member is disposed at least partially along the second layer and is rotatable in a first direction and a second direction, opposite the first direction. The plurality of fastening elements is disposed at least partially along the second layer and corresponds to a respective aperture of the plurality of apertures. The connecting element operatively connects the plurality of fastening elements with the fastening member. The fastening mechanism is configured such that, when the fastening member is rotated in the first direction, each of the plurality of fastening elements are simultaneously rotated from a first position toward a second position. The fastening system is configured to be adjustable between a loosened configuration, in which the plurality of fastening elements is in the first position and aligned within the plurality of apertures, and a tightened configuration, in which the plurality of fastening elements is in the second position and misaligned with the plurality of apertures.

In some embodiments, the present disclosure provides an article that includes a fastening system and an opening with a first fastening portion and a second fastening portion that is configured to be fastened with the first fastening portion to close the opening of the article. The fastening system includes a plurality of apertures and a fastening mechanism. The plurality of apertures is defined along the second fastening portion and extends at least partially through the second fastening portion. The fastening mechanism includes a fastening member that is rotatable in a first direction and in a second direction, opposite the first direction, and a plurality of fastening elements that is disposed in a line and spaced from the fastening member. The plurality of fastening elements is operatively connected to the fastening member by a connecting element and each of the plurality of fastening elements corresponds with a respective aperture of the plurality apertures. The fastening mechanism is configured such that, when the fastening member is rotated in the first direction, each of the plurality of fastening elements are simultaneously rotated from a first position toward a second position. The fastening system is configured to be moveable between an unfastened configuration, in which each of the fastening elements is in the first position and aligned within each respective aperture of the plurality of apertures, and a fastened configuration, in which each of the fastening elements is in the second position and offset with respect to each respective aperture of the plurality of apertures.

Other aspects of the fastening system for an article, such as the article of footwear having the fastening system, including features and advantages thereof, will become apparent to one of ordinary skill in the art upon examination of the figures and detailed description herein. Therefore, all such aspects of the fastening system for an article, including the article of footwear having the fastening system, are intended to be included in the detailed description and this summary.

DETAILED DESCRIPTION OF THE DRAWINGS

Figure 1:
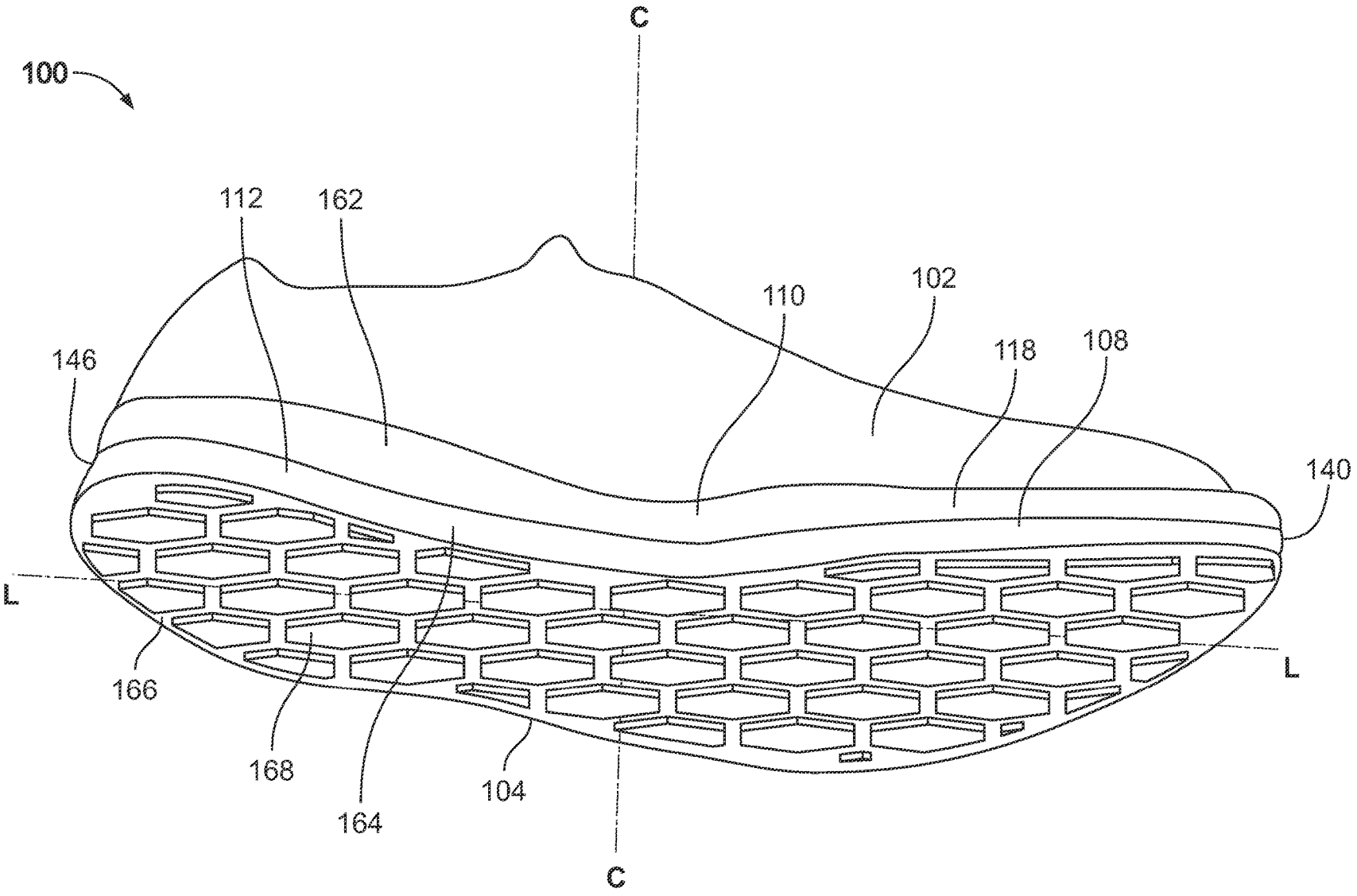
FIG. 1 is a perspective view of a bottom and medial side of an article of footwear configured as a left shoe that includes an upper and a sole structure, according to an embodiment of the disclosure.

Some aspects of the following discussion and accompanying figures disclose various embodiments or configurations of an article, such as an article of footwear or a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The term "elastomeric," as used herein, refers to elastic or rubber-like properties of a material, e.g., a polymer. For example, reference to an "elastomeric material" is intended to refer to a material being configured to elastically deform when a load is applied to the material and to regain its original shape when the load is removed from the material. Thus, a first material can have elastomeric properties or that is configured to have a certain first elasticity that can be greater than or less than a second material with or without elastomeric properties or that is configured to have a certain second elasticity.

Further, as used herein, unless otherwise defined or limited, directional terms are used for convenience of reference for discussion of particular figures or examples. For example, references to "downward," or other directions, or "lower" or other positions, may be used to discuss aspects of a particular example or figure, but do not necessarily require similar orientation or geometry in all installations or configurations. The terms first, second, third, etc. may be used herein to describe various elements, components, regions, layers, and/or sections. These elements, components, regions, layers, and/or sections should not be limited by these terms. These terms may be only used to distinguish one element, component, region, layer, or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations.

Aspects of the present disclosure are directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

The following discussion and accompanying FIGS. 1-13 disclose various embodiments or configurations of an article of footwear. The article of footwear can be provided as a pair of shoes including a first or left shoe and a second or right shoe. The left shoe and the right shoe may be similar in all material aspects, except that the left shoe and the right shoe are sized and shaped to receive a left foot and a right foot of a user, respectively. For ease of disclosure, a single shoe or article of footwear will be referenced to describe aspects of the disclosure. In some figures, the article of footwear is depicted as a right shoe, and in some figures the article of footwear is depicted as a left shoe. The disclosure below with reference to the article of footwear is applicable to both the left shoe and the right shoe. In some embodiments, there may be differences between the left shoe and the right shoe other than the left/right configuration. In some embodiments, the left shoe may include a frame, while the right shoe may not include the frame, or vice versa. Further, in some embodiments, the left shoe may include one or more additional elements that the right shoe does not include, or vice versa.

Figure 2:
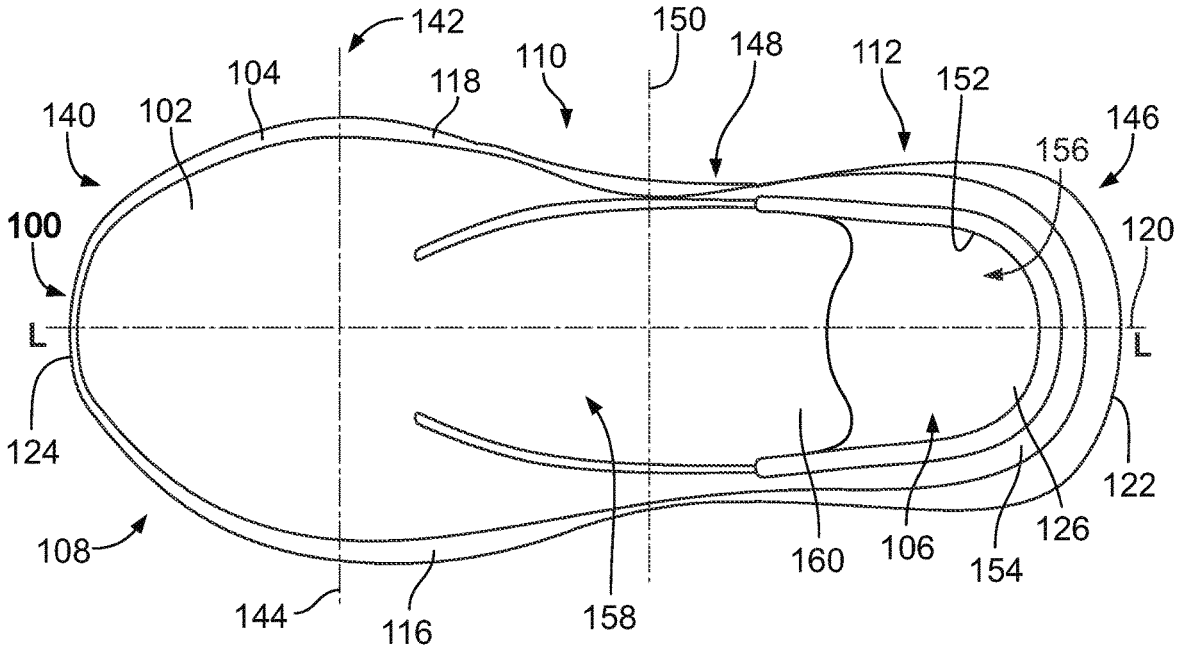
FIG. 2 is a top view of the article of footwear of FIG. 1.
Figure 3:
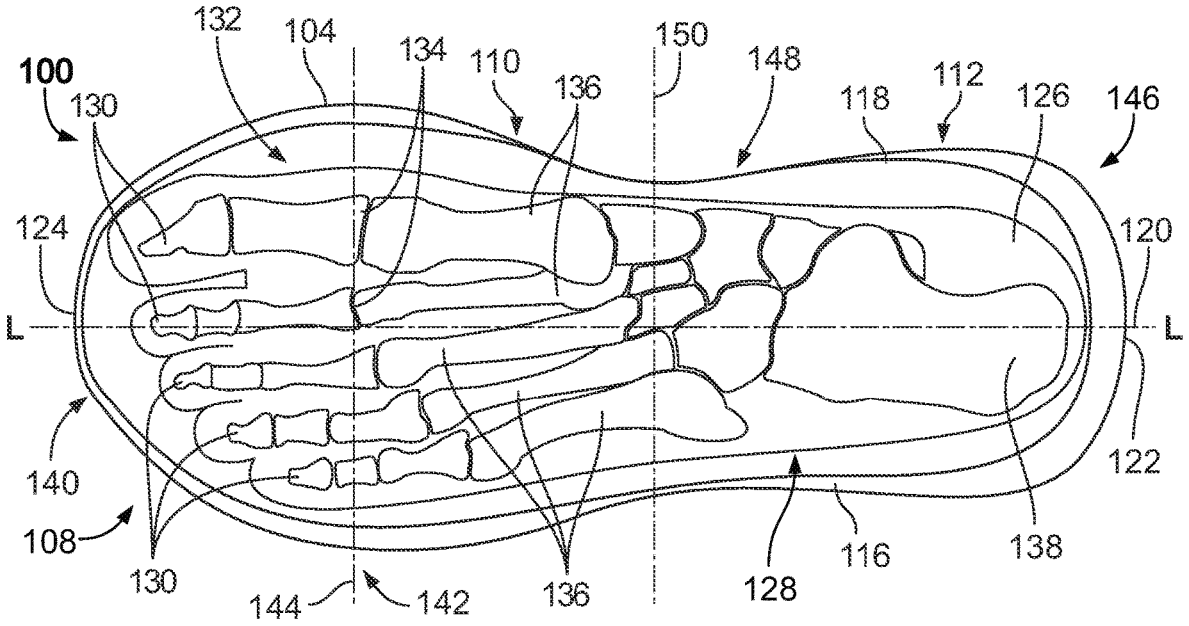
FIG. 3 is a top plan view of the article of footwear of FIG. 1 with an upper removed and a user's skeletal foot structure overlaid thereon.

Referring to FIGS. 1-3, an exemplary embodiment of an article of footwear 100 is shown, including an upper 102 and a sole structure 104. The upper 102 is attached to the sole structure 104 and together define an interior cavity 106 (see FIGS. 2 and 3) into which a foot may be inserted. For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. In some embodiments, a heel plate or cover (not shown) may be provided within the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. In some embodiments, the sole structure 104 may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Furthermore, the insole can be positioned within the interior cavity of the upper, which can be in direct contact with a user's foot while an article of footwear is being worn. Moreover, the upper 102 may also include a liner (not shown) that can increase comfort, for example, by reducing friction between the foot of the user and the upper, the sole, the insole, or the like, and/or by providing moisture wicking properties. The liner may line the entirety of the interior cavity or only a portion thereof. In some embodiments, a binding (not shown) may surround the opening of the interior cavity to secure the liner to the upper and/or to provide an aesthetic element on the article of footwear.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral and medial sides 116, 118. The lateral and medial sides 116, 118 adjoin one another along a longitudinal central plane or axis 120 of the article of footwear 100, which is coplanar with the longitudinal axis L of FIG. 1. As will be further discussed herein, the longitudinal central plane or axis 120 may demarcate a central, intermediate axis between the lateral and medial sides 116, 118 of the article of footwear 100. Put differently, the longitudinal plane or axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or axis 120 is a straight axis extending through the rear, proximal end 122 of the heel region 112 to the front, distal end 124 of the forefoot region 108.

Unless otherwise specified, and referring to FIGS. 2 and 3, the article of footwear 100 may be defined by the forefoot region 108, the midfoot region 110, and the heel region 112. The forefoot region 108 may generally correspond with portions of the article of footwear 100 that encase portions of a foot 128 that include the toes or phalanges 130, the ball 132 of the foot 128, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch and a bridge of a foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the lateral side 116, and the medial side 118 are intended to define boundaries or areas of the article of footwear 100. To that end, the forefoot region 108, the midfoot region 110, the heel region 112, the lateral side 116, and the medial side 118 generally characterize sections of the article of footwear 100. Certain aspects of the disclosure may refer to portions or elements that are coextensive with one or more of the forefoot region 108, the midfoot region 110, the heel region 112, the lateral side 116, and/or the medial side 118. Further, both the upper 102 and the sole structure 104 may be characterized as having portions within the forefoot region 108, the midfoot region 110, the heel region 112, and/or along the lateral side 116 and/or the medial side 118. Therefore, the upper 102 and the sole structure 104, and/or individual portions of the upper 102 and the sole structure 104, may include portions thereof that are disposed within the forefoot region 108, the midfoot region 110, the heel region 112, and/or along the lateral side 116 and/or the medial side 118.

Still referring to FIGS. 2 and 3, the forefoot region 108, the midfoot region 110, the heel region 112, the lateral side 116, and the medial side 118 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the lateral side 116, and/or the medial side 118 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the lateral side 116, and/or the medial side 118 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146 and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146 and terminates at a point where the lateral side 116 meets the longitudinal, central axis 120.

Still referring to FIGS. 2 and 3, the upper 102 extends along the lateral and the medial sides 116, 118, and across the forefoot region 108, the midfoot region 110, and the heel region 112 to house and enclose a foot of a user. When fully assembled, the upper 102 also includes an interior surface 152 and an exterior surface 154. The interior surface 152 faces inward and generally defines the interior cavity 106, and the exterior surface 154 of the upper 102 faces outward and generally defines an outer perimeter or boundary of the upper 102. The upper 102 also includes an opening 156 that is at least partially located in the heel region 112 of the article of footwear 100, which provides access to the interior cavity 106 and through which a foot may be inserted and removed. In some embodiments, the upper 102 may also include an instep region 158 that extends from the opening 156 in the heel region 112 over an area corresponding to an instep of a foot to an area proximate the forefoot region 108. The instep region 158 may comprise an area similar to where a tongue 160 of the present embodiment is disposed. In some embodiments, the upper 102 does not include the tongue 160, i.e., the upper 102 is tongueless.

In the illustrated embodiment, the sole structure 104 includes a midsole 162 and an outsole 164. The outsole 164 may define a bottom end or bottom surface 166 of the sole structure 104 across the heel region 112, the midfoot region 110, and the forefoot region 108. Further, the outsole 164 may be a ground-engaging portion or include a ground-engaging surface of the sole structure 104 and may be opposite of the insole thereof. As illustrated in FIG. 1, the bottom surface 166 of the outsole 164 may include a tread pattern 168 that can include a variety of shapes and configurations. The outsole 164 may be formed from one or more materials to impart durability, wear-resistance, abrasion resistance, or traction to the sole structure 104. In some embodiments, the outsole 164 may be formed from any kind of elastomer material, e.g., rubber, including thermoset elastomers or thermoplastic elastomers, or a thermoplastic material, e.g., thermoplastic polyurethane (TPU). In some embodiments, the outsole 164 may define a shore A hardness up to 95. In addition, the outsole 164 may be manufactured by a process involving injection molding, vulcanization, printing layer by layer, i.e., additive manufacturing systems or methods, and the like.

Still referring to FIG. 1, the midsole 162 may be individually constructed from a thermoplastic material, such as polyurethane (PU), for example, and/or an ethylene-vinyl acetate (EVA), copolymers thereof, or a similar type of material. In other embodiments, the midsole 162 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 162 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 162 is manufactured by a process involving injection molding, vulcanization, printing layer by layer, i.e., additive manufacturing systems or methods, and the like.

In embodiments where the midsole 162 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 162 may be formed using alternative methods known in the art, including the use of an expansion press, an injection machine, a pellet expansion process, a cold foaming process, a compression molding technique, die cutting, or any combination thereof. For example, the midsole 162 may be formed using a process that involves an initial foaming step in which supercritical gas is used to foam a material and then compression molded or die cut to a particular shape.

Figure 4:
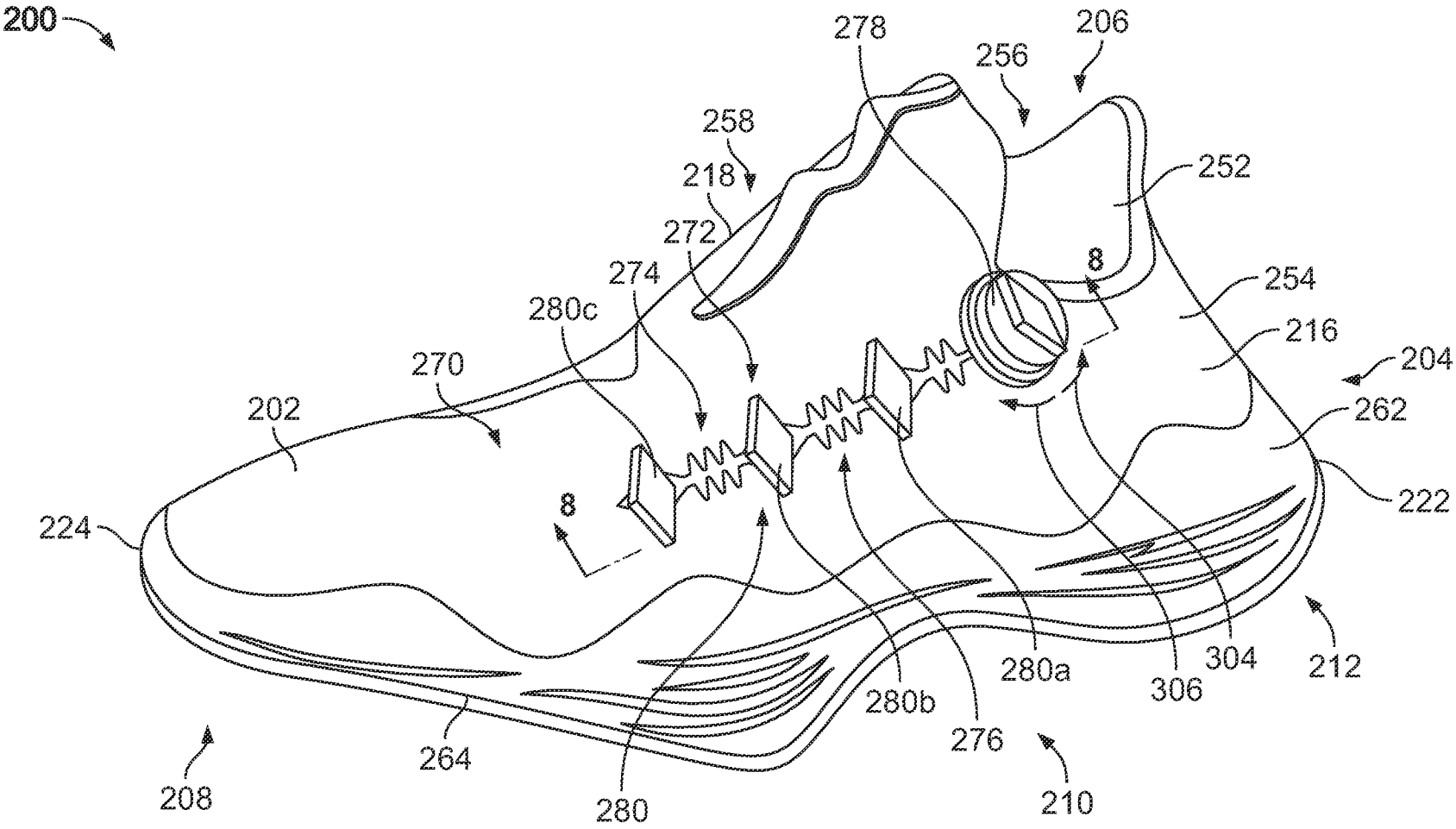
FIG. 4 is a perspective view of a lateral and toe side of an article of footwear configured as a left shoe with a fastening system in a loosened configuration, according to an embodiment of the disclosure.

Now referring to FIG. 4, an exemplary article of footwear 200 is shown, which includes a sole structure 204 having a midsole 262 and an outsole 264, an upper 202 attached to the sole structure 204, and a fastening system 270. The fastening system 270 includes a fastening mechanism 272 that is configured to operatively engage a channel 274 in the upper 202 having a plurality of apertures 276 to tighten and/or loosen the article of footwear 200 around a user's foot. In the illustrated embodiment, the fastening system 270 is arranged on the lateral side 216 of the upper 202 adjacent to the instep region 258 of the footwear 200 and at least partially within each of the midfoot region 210 and the heel region 212. In some embodiments, the fastening system 270 is arranged entirely within the midfoot region 210. In some embodiments, the fastening system 270 is arranged within each of the forefoot, midfoot, and heel regions 208, 210, 212 of the footwear 200. In some embodiments, in addition to or alternative to the lateral side 216, the fastening system 270 is arranged on the medial side (not shown) of the upper 202 of the footwear 200. For example, in some embodiments, the fastening system 270 is arranged at least partially on each of the lateral side 216 and the medial side (not shown) of the upper 202 of the footwear 200. In some embodiments, the fastening system 270 is arranged along the instep region 258, adjacent to both the opening 256 and the distal end 224 of the upper 202, opposite the proximal end 222 of the article of footwear 200.

Figure 5:
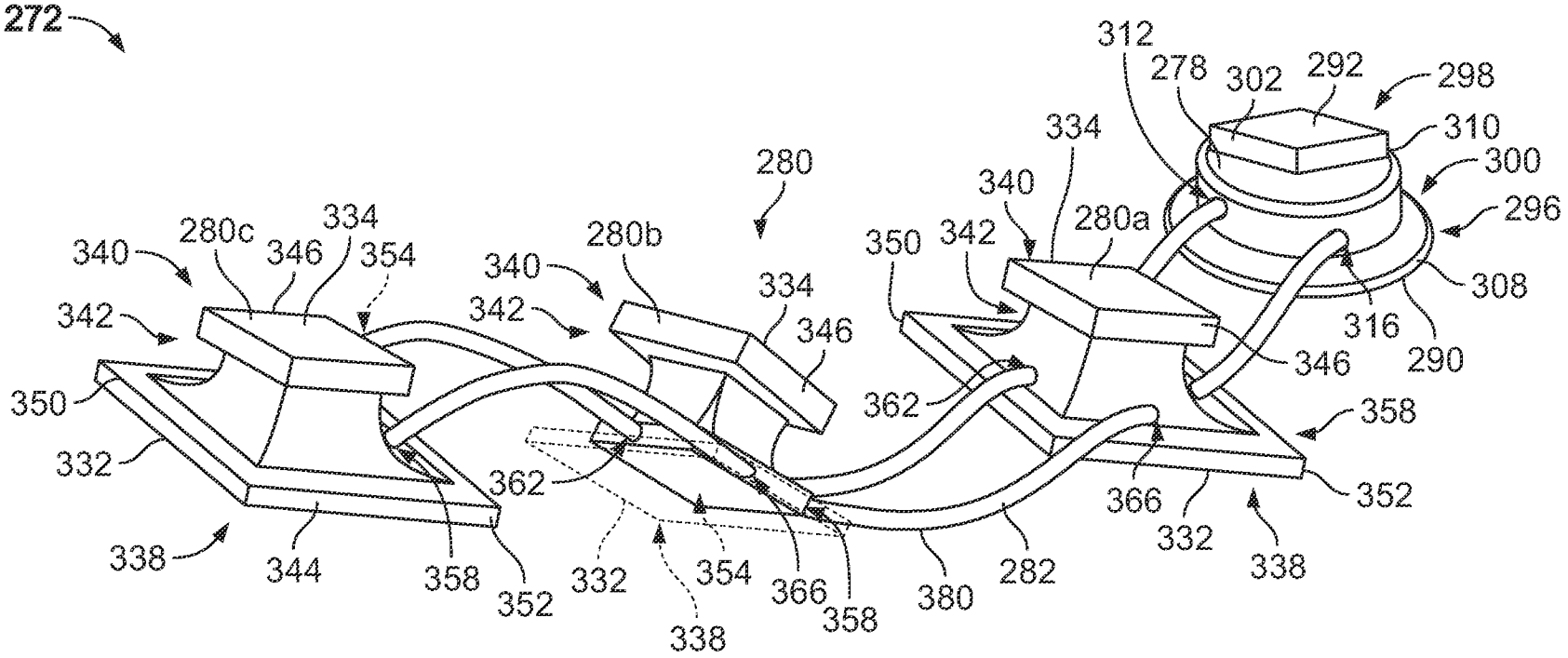
FIG. 5 is a perspective view of a fastening mechanism of the fastening system of FIG. 4.
Figure 6:
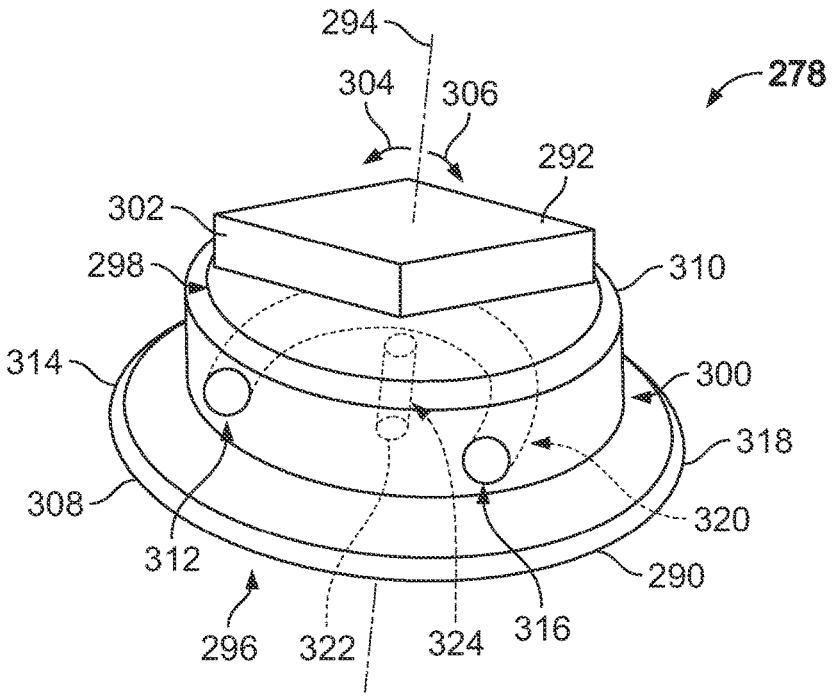
FIG. 6 is a perspective view of a fastening member of the fastening mechanism of FIG. 5.
Figure 7:
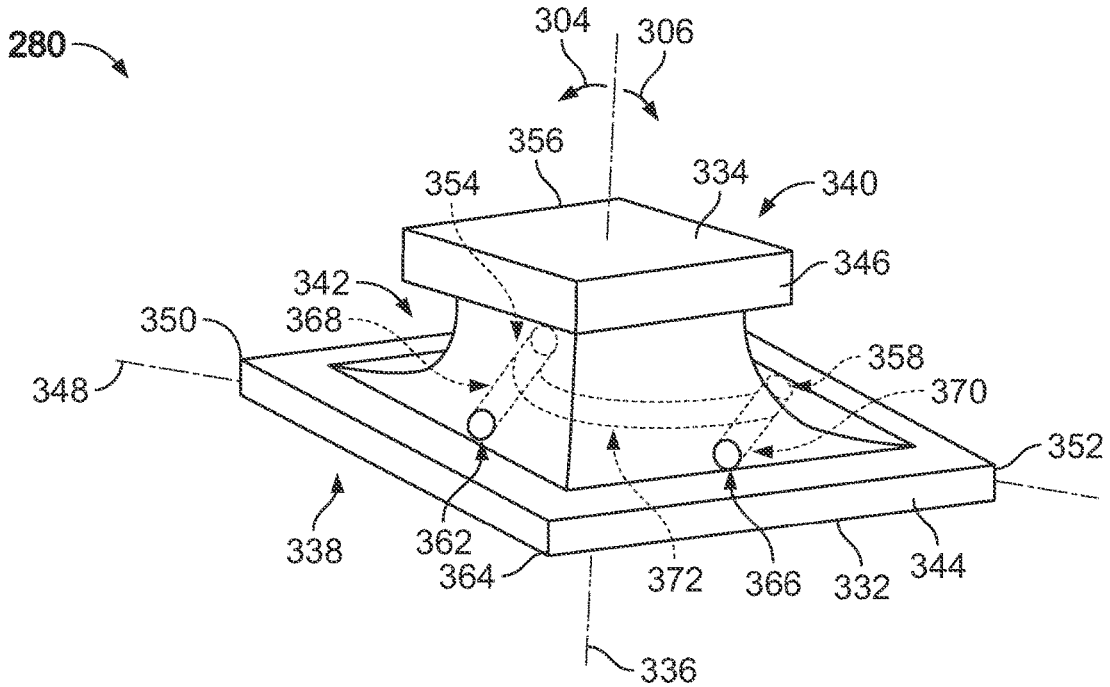
FIG. 7 is a perspective view of a fastening element of the fastening mechanism of FIG. 5.

Referring now to FIGS. 5-7, the fastening mechanism 272 of the fastening system 270 of the footwear 200 is shown in greater detail. Referring specifically to FIG. 5, the fastening mechanism 272 includes a fastening member 278 and a plurality of fastening elements 280 that are operatively engaged with the fastening member 278 via a connecting element 282. In the illustrated embodiment, the plurality of fastening elements 280 includes a first or proximal fastening element 280*a* arranged adjacent to the fastening member 278, a second or mid-proximal fastening element 280*b* arranged adjacent to the first fastening element 280*a*, opposite the fastening member 278, and a third or distal fastening element 280*c* arranged adjacent to the second fastening element 280*b*, opposite the first fastening element 280*a*. In other words, the plurality of fastening elements 280 are arranged in a line and spaced from the fastening member 278, with the first fastening element 280*a* being closest to the fastening member 278, the third fastening member 280*c* being farthest from the fastening member 278, and the second fastening element 280*b* being between the first and third fastening elements 280*a*, 280*c*. In some embodiments, the plurality of fastening elements 280 can include two or four or more fastening elements operatively connected to the fastening member 278.

In some embodiments, the plurality of fastening elements 280 can include a first plurality of fastening elements and a second plurality of fastening elements having different properties, e.g., shapes, colors, and materials, than the first plurality of fastening elements. In such embodiments, one or more fastening elements of the first plurality of fastening elements can have different properties than other fastening elements of the first plurality of fastening elements and the second plurality of fastening elements. In some embodiments, the plurality of fastening elements 280 can include two or more fastening elements that each have different properties than one another. In some embodiments, one or more of the plurality of fastening elements 280 can be arranged from a first side of the fastening member 278 and one or more of the plurality of fastening elements 280 can be arranged from a second side of the fastening member 278, opposite the first side.

Referring specifically now to FIG. 6, the fastening member 278 of the fastening mechanism 272 is shown in greater detail. The fastening member 278 has a first or inner end 290, a second or outer end 292 opposite the inner end 290, and a fastening member axis 294 extending through the inner and outer ends 290, 292. Further, the fastening member 278 has a first or inner portion 296 extending from the inner end 290 toward the outer end 292, a second or outer portion 298 extending from the outer end 292 toward the inner end 290, and a third or central portion 300 extending between the inner and outer portions 296, 298. A fastening protrusion 302 extends outwardly from the outer portion 298 and is configured to be gripped by a user to rotate the fastening member 278 in a first direction 304 or a second direction 306, opposite the first direction 304, about the fastening member axis 294. The inner portion 296 has a first outer perimeter 308 with a first geometric shape, and the outer portion 298 has a second outer perimeter 310 having a second geometric shape. In the illustrated embodiment, the first and second geometric shapes of the first and second outer perimeters 308, 310 of the inner and outer portions 296, 298, respectively, of the fastening member 278 have a similar circular shape. In some embodiments, the first geometric shape of the first outer perimeter 308 can be different than the second geometric shape of the second outer perimeter 310 of the fastening member 278.

With continued reference to FIG. 6, in the illustrated embodiment, the fastening member 278 includes a first opening 312 extending into the central portion 300 toward a first or upper circumferential side 314 and a second opening 316 extending into the central portion 300 near a second or lower circumferential side 318 of the fastening member 278. As discussed in greater detail below, in some embodiments, the first and second openings 312, 316 of the fastening member 278 can be connected such that the first and second openings 312, 316 form an internally connected opening or internal passage 320 of the fastening member 278. In some embodiments, the first and second openings 312, 316 can extend only partially into the central portion 300 of the fastening member 278.

It is contemplated that the fastening member 278 may be configured such that the outer and central portions 298, 300 are rotatable relative to the inner portion 296 and/or with respect to one another. For example, referring still to FIG. 6, the inner portion 296 can include a coupling protrusion 322 extending upwardly along the fastening member axis 294 that can be received within a coupling recess 324 of the central portion 300 that is aligned with and configured to receive the coupling protrusion of the inner portion 296. In such embodiments, when a user rotates the fastening protrusion 302 of the outer portion 298 in the first direction 304, the central and outer portions 298, 300 rotate in the first direction 304 while the inner portion 296 remains stationary. In other embodiments, other known structures can be included on and/or within the fastening member 278 to permit the outer portion 298 to be rotatable relative to at least the inner portion 296. For example, in some embodiments, the fastening member 278 can include an outer lip (not shown) arranged along the central portion 300 and that can be slidably received within an inner channel (not shown) of the inner portion 296 of the fastening member 278.

Referring specifically now to FIG. 7, one of the plurality of fastening elements 280 is shown in greater detail. For illustration purposes, only one of the plurality of fastening elements 280 is shown in detail. In the illustrated embodiment, the first, second, and third fastening elements 280*a*, 280*b*, 280*c* of the plurality of fastening elements 280 are each configured generally similarly to the illustrated fastening element 280. As shown in FIG. 7, the fastening element 280 has a first or inner end 332, a second or outer end 334 opposite the inner end 332, and a fastening element axis 336 extends through the inner and outer ends 332, 334. Further, a first or inner portion 338 extends from the inner end 332 toward the outer end 334, a second or outer portion 340 extends from the outer end 334 toward the inner portion 338, and a third or central portion 342 extends between the inner and outer portions 338, 340 of the fastening element 280.

Referring still to FIG. 7, the inner portion 338 has a first outer perimeter 344 having a first geometric shape, and the outer portion 340 has a second outer perimeter 346 having a second geometric shape. In the illustrated embodiment, the first and second geometric shapes of the first and second outer perimeters 344, 346 of the inner and outer portions 338, 340, respectively, of the fastening element 280 are each shaped as an elongated rhombus with two opposing points being aligned along a fastening element longitudinal axis 348. In some embodiments, the first geometric shape of the first outer perimeter 344 of the inner portion 338 can be different than the second geometric shape of the second outer perimeter 346 of the outer portion 340. In some embodiments, the first outer perimeter 344 of the inner portion 338 can be circular shaped while the second outer perimeter 346 of the outer portion 340 can be triangular shaped. In some embodiments, the first geometric shape of the first outer perimeter 344 can be non-polygonal while the second geometric shape of the second outer perimeter 346 can be polygonal, or vice versa. In some embodiments, the second outer perimeter 346 of the outer portion 340 can have a regular or irregular polygonal shape, such as, e.g., a triangular shape, a quadrilateral shape, a pentagonal shape, a hexagonal shape, or an octagonal shape.

With continued reference to FIG. 7, the fastening element 280 has a first longitudinal side 350 and a second longitudinal side 352 opposite the first longitudinal side 350, with the fastening element longitudinal axis 348 extending through the first and second longitudinal sides 350, 352. In the illustrated embodiment, a first opening 354 extends at least partially into the central portion 342 toward the first longitudinal side 350 on a third side 356 of the fastening element 280, and a second opening 358 extends at least partially into the central portion 342 toward the second longitudinal side 352 on the third side 356. Further, a third opening 362 extends at least partially into the central portion 342 on a fourth side 364, opposite the third side 356, toward the first longitudinal side 350 opposite the first opening 354, and a fourth opening 366 extends at least partially into the central portion 342 on the fourth side 364, opposite the second opening 358. As discussed in greater detail below, in some embodiments, the first and third openings 354, 362 of at least the first and second fastening elements 280*a*, 280*b* can form an internally connected opening or a first internal passage 368 and the second and fourth openings 358, 366 can form an internally connected opening or a second internal passage 370. Likewise, in some embodiments, at least the third fastening element 280*c* can include only the first and second openings 354, 358, which form an internally connected opening or a third internal passage 372.

It is contemplated that one or more of the plurality of fastening elements 280 can comprise two or more materials. For example, referring still to FIG. 7, the inner and outer portions 338, 340 of at least one of the plurality of fastening elements 280 may comprise a first material and the central portions 342 of such fastening elements 280 may comprise a second material having different properties than the first material. In such embodiments, the inner and outer portions 338, 340 of the fastening elements 280 may comprise a rigid material while the central portions 342 may comprise an elastomeric or flexible material, such that the central portion 342 is configured to be elastically deformable along the fastening element axis 336 when a tensile force is applied to the inner portion 338 and/or the outer portion 340. In some embodiments, one or more of the inner portion 338, the outer portion 340, and/or the central portion 342 of one or more of the plurality of fastening elements 280 can comprise two or more materials. In some embodiments, one or more of the longitudinal sides 350, 352 of the outer portion 340 can comprise a first material while remaining portions of the outer portion 340 can comprise a second material having different properties than the first material.

Referring again to FIG. 5, in the illustrated embodiment, the connecting element 282 of the fastening mechanism 272 is a wire 380 that is arranged to be connected to each of the plurality of fastening elements 280 and to the fastening member 278. More specifically, the wire 380 is connected to the fastening member 278 through each of the first and second openings 312, 316. The wire 380 extends through each of the first, second, third, and fourth openings 354, 358, 362, 366 of the first and second fastening elements 280*a*, 280*b*, and each of the first and second openings 354, 358 of the third fastening element 280*c*. In some embodiments, the wire 380 is fixedly attached to the fastening member 278 and each of the plurality of fastening elements 280. In some embodiments, the wire 380 is slidably connected to the fastening member 278 and/or one or more of the plurality of fastening elements 280. In some embodiments, the wire 380 is fixedly attached to or within the first and third openings 354, 362 and to the second and fourth openings 358, 366 of at least the first and second fastening elements 280*a*, 280*b*.

It is contemplated that, in some embodiments, the connecting element 282 can comprise a plurality of wires. For example, in such embodiments, the connecting element 282 can include a first wire and a second wire. Referring still to FIG. 5, the first wire can have a first end fixedly attached to or within the first opening 312 of the fastening member 278, a second end fixedly attached to or within the first opening 354 of the third fastening element 280*c*, and a middle portion extending through the first internal passages 368 (see FIG. 7) of the first and second fastening elements 280*a*, 280*b*. Likewise, the second wire can have a first end fixedly attached to or within the second opening 316 of the fastening member 278, a second end fixedly attached to or within the second opening 358 of the third fastening element 280*c*, and a middle portion extending through the second internal passages 370 (see FIG. 7) of the first and second fastening elements 280*a*, 280*b*. In some embodiments, the plurality of wires can be fixedly attached to or within each of the openings 312, 316 of the fastening member 278 and each of the openings 354, 358, 362, 366 of the plurality of fastening elements 280.

For example, in such embodiments, the plurality of wires can include a first wire fixedly attached to or within the first opening 312 of the fastening element 280 and to or within the first opening 354 of the first fastening element 280*a*, a second wire fixedly attached to or within the third opening 362 of the first fastening element 280*a* and to or within the first opening 354 of the second fastening element 280*b*, a third wire fixedly attached to or within the third opening 362 of the second fastening element 280*b* and to or within the first opening 354 of the third fastening element 280*c*, a fourth wire fixedly attached to or within the second opening 358 of the third fastening element 280*c* and to or within the fourth opening 366 of the second fastening element 280*b*, a fifth wire fixedly attached to or within the second opening 358 of the second fastening element 280*b* and to or within the fourth opening 366 of the first fastening element 280*a*, and a sixth wire fixedly attached to or within the second opening 358 of the first fastening element 280*a* and to or within the second opening 316 of the fastening member 278.

It is further contemplated that the connecting element 282 can comprise only a single wire. For example, referring to FIGS. 5-7, in such embodiments, a first end of the single wire can be fixedly attached to or within the first opening 312 of the fastening element 280 and can extend through the first internal passages 368 of the first and second fastening elements 280*a*, 280*b*, through the third internal passage 372 of the third fastening element 280*c*, through the second internal passages 370 of the first and second fastening elements 280*a*, 280*b*, and a second end of the wire can be fixedly attached to or within the second opening 316 of the fastening element 280. In some embodiments, the wire 380 can be a closed loop wire. For example, in such embodiments, the closed loop wire can extend from the internal passage 320 of the fastening member 278, through the first internal passages 368 of the first and second fastening elements 280*a*, 280*b*, through the third internal passage 372 of the third fastening element 280*c*, and through the second internal passages 370 of the first and second fastening elements 280*a*, 280*b*.

Referring again to FIG. 5, the wire 380 of the fastening mechanism 272 may comprise various materials, such as, for example, conventional cotton, nylon, or polyester and can have a circular cross-section to prevent twisting along the fastening member 278 and the plurality of fastening elements 280 while providing improved operation of the fastening system 270. In some embodiments, the wire 380 can be configured to be elastically deformable along a length of the wire 380, such as when the wire 380 is subjected to a tensile force. In some embodiments, the wire 380 comprises a high modulus polyethylene fiber cable having increased strength and abrasion resistance compared to conventional shoelaces. In some embodiments, the wire 380 can include a first wire comprising a first material and a second wire comprising a second material having differing properties, e.g., color, thickness, or elasticity, than the first material. In some embodiments, the wire 380 has a diameter in a range between about 0.20 millimeters (mm) and about 3.0 mm, between about 0.40 mm and about 2.5 mm, between about 0.60 mm and about 2.0 mm, or between about 0.8 mm and about 1.2 mm.

Figure 8:
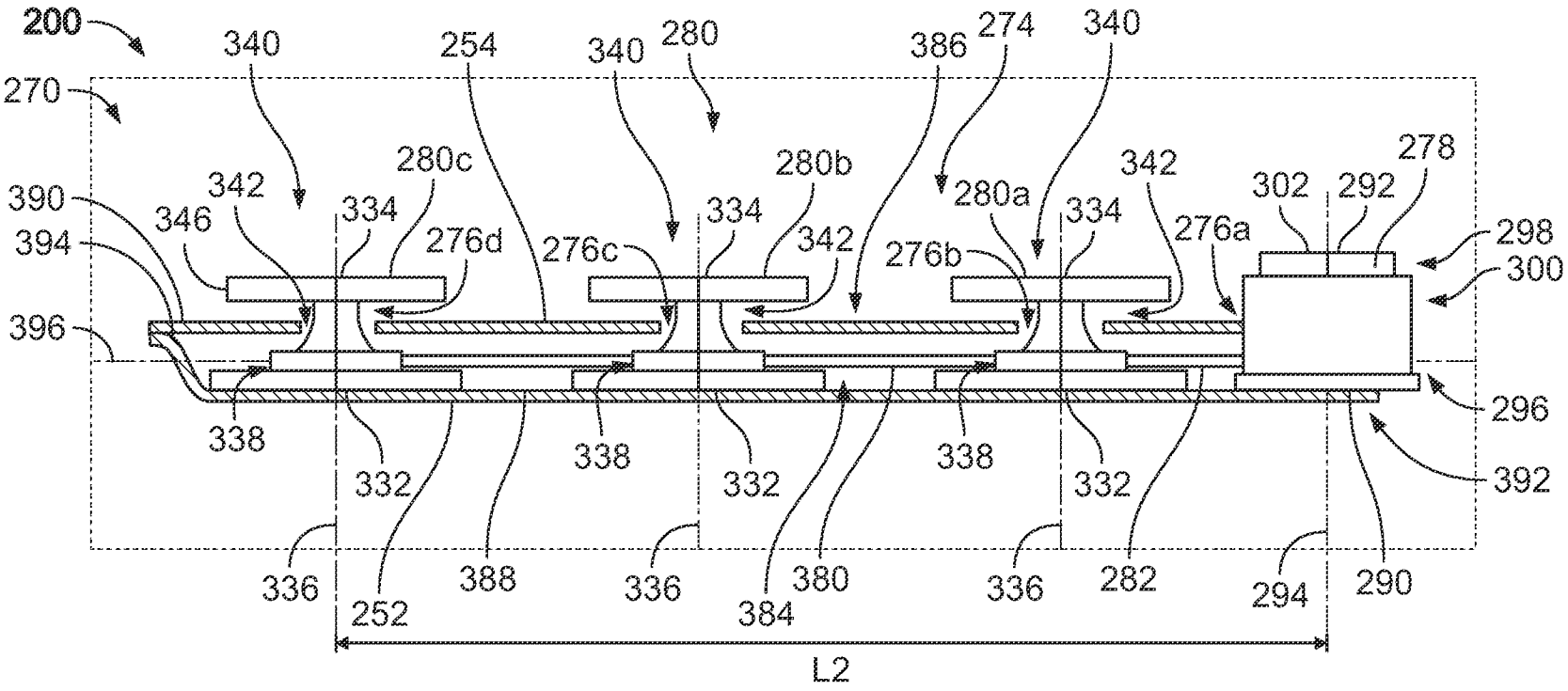
FIG. 8 is a cross-sectional view taken along line 8-8 of FIG. 4.
Figure 9:
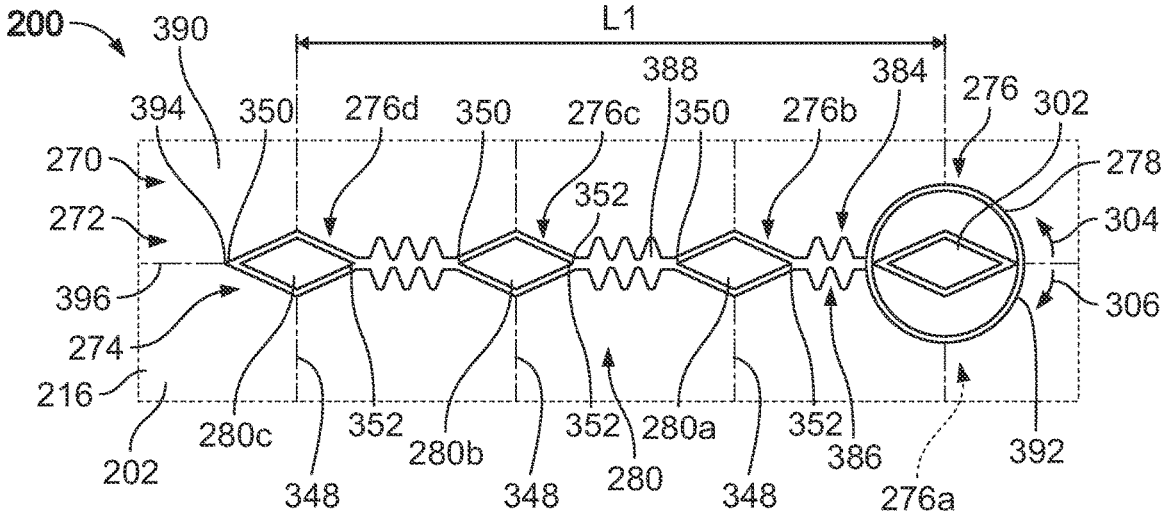
FIG. 9 is a lateral side detail view of the fastening system of FIG. 4 in a loosened configuration.
Figure 10:
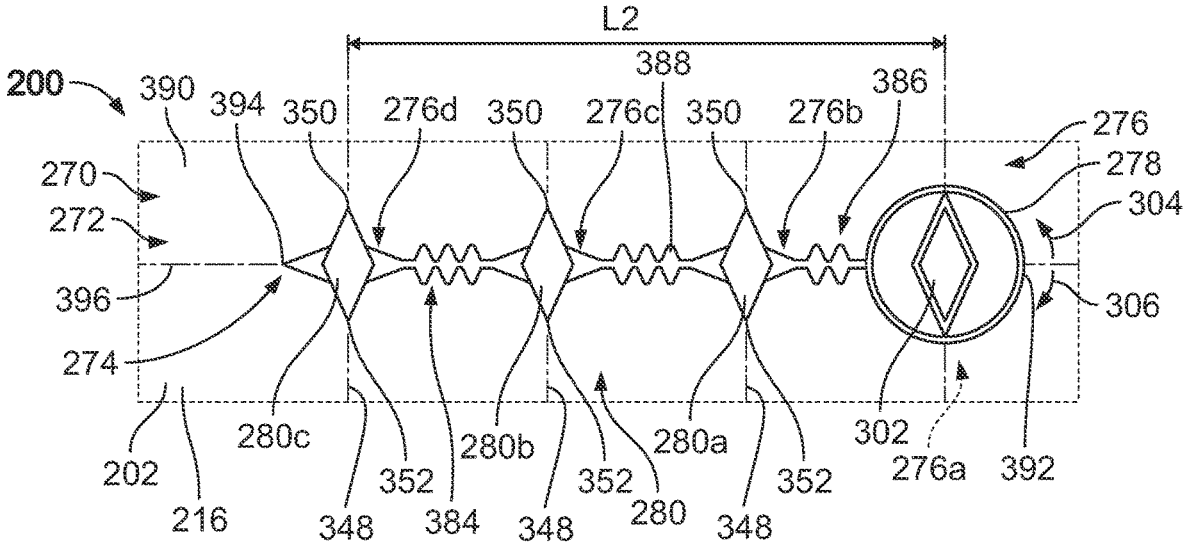
FIG. 10 is a lateral side detail view of the fastening system of FIG. 4 in a tightened configuration.

Referring to FIGS. 8-10, the fastening system 270 of the article of footwear 200 is shown in greater detail. Referring specifically to FIG. 8, a cross-sectional view taken along line 8-8 of FIG. 4 shows the fastening mechanism 272 partially disposed within a channel compartment 384 of the channel 274 of the upper 202 of the footwear 200 and partially extending through a channel opening 386 of the channel 274 that is defined by the exterior surface 254 of the upper 202 and extends along the channel compartment 384. The channel compartment 384 of the channel 274 can be defined at least partially by interior and exterior surfaces 252, 254 of the upper 202. In the illustrated embodiment, the channel compartment 384 is defined by a first or inner layer 388 of the upper 202 that at least partially defines the interior surface 252 and a second or outer layer 390 of the upper 202 that at least partially defines the exterior surface 254. In other words, the fastening mechanism 272 is disposed along the inner layer 388 of the upper 202. The channel 274 has a first or proximal end 392, a second or distal end 394, opposite the proximal end 392, and a longitudinal channel axis 396 extending through the proximal and distal ends 392, 394.

In the illustrated embodiment, the proximal end 392 of the channel 274 is open while the distal end 394 of the channel 274 is closed. In some embodiments, both the proximal and distal ends 392, 394 of the channel 274 are closed or are open. In some embodiments, the inner layer 388 of the upper 202 can be included only along a portion of the outer layer 390 that includes the channel opening 386. In some embodiments, the inner layer 388 can be connected to the outer layer 390 at least around a periphery of the channel compartment 384. In some embodiments, the inner layer 388 of the upper 202 can extend across at least a portion of the instep region 258 between the lateral and medial sides 216, 218 (see FIG. 4) of the upper 202. In some embodiments, the inner layer 388 can extend along the entire outer layer 390. In some embodiments, the inner layer 388 can comprise a first material and the outer layer 390 can comprise a second material having one or more properties that differ from the first material, such as, e.g., elasticity, permeability, etc. In some embodiments, the upper 202 can be single layered and the channel compartment 384 can be defined in a portion of the upper 202 in which the interior and exterior surfaces 252, 254 of the upper 202 are disconnected along the channel opening 386.

Still referring to FIG. 8, the plurality of apertures 276 are arranged along the channel opening 386 and extend through the exterior surface 254 and the outer layer 390 of the upper 202 and open into the channel compartment 384. In other words, the plurality of apertures 276 are defined along the outer layer 390 of the upper 202. In the illustrated embodiment, the plurality of apertures 276 includes a first or proximal aperture 276*a* disposed toward the proximal end 392 of the channel 274, a second or mid-proximal aperture 276*b* disposed adjacent to the first aperture 276*a* between the first aperture 276*a* and the distal end 394 of the channel 274, a third or mid-distal aperture 276*c* disposed adjacent to the second aperture 276*b* between the second aperture 276*b* and the distal end 394 of the channel 274, and a fourth or distal aperture 276*d* disposed adjacent to both the distal end 394 of the channel 274 and the third aperture 276*c*. In other words, the plurality of apertures 276 of the channel 274 are arranged in a line along the channel opening 386, with the first aperture 276*a* being closest to the proximal end 392 of the channel 274, the fourth aperture 276*d* being closest to the distal end 394 of the channel 274, the second aperture 276*b* being closer to the proximal end 392 of the channel 274 than the third aperture 276*c*, and the third aperture 276*c* being closer to the distal end 394 of the channel 274. Further, the first aperture 276*a* is closer to the proximal end 222 of the footwear 200 than at least the second aperture 276*b*, and the fourth aperture is closer to the distal end 224 of the footwear 200 than at least the third aperture 276*c* (see FIG. 4). In some embodiments, the first aperture 276*a* can be disposed closer to the distal end 224 of the footwear 200 than at least the fourth aperture 276*d*. In some embodiments, the plurality of apertures 276 of the channel 274 can include two, three, or five or more apertures.

The plurality of apertures 276 can have various geometric shapes. In the illustrated embodiment, the first aperture 276*a* has a first geometric shape while the second, third, and fourth apertures 276*b*, 276*c*, 276*d* have a second geometric shape that is different than the first geometric shape of the first aperture 276*a*. More specifically, the first aperture 276*a* is generally circular shaped and the second, third, and fourth apertures 276*b*, 276*c*, 276*d* have a similar generally irregular rhombus shape. In some embodiments, each of the plurality of apertures 276 can have the same geometric shape. In some embodiments, the second aperture 276*b* can have a geometric shape that is different than geometric shapes of the third aperture 276*c* and/or the fourth aperture 276*d*. In some embodiments, the fourth aperture 276*d* can have a geometric shape that is different than geometric shapes of the second aperture 276*b* and/or third aperture 276*c*.

With continued reference to FIG. 8, the fastening mechanism 272 is arranged at least partially within the channel compartment 384 of the channel 274, such that the fastening member 278 is aligned with and received by the first aperture 276*a*, the first fastening element 280*a* is aligned with the second aperture 276*b*, the second fastening element 280*b* is aligned with the third aperture 276*c*, and the third fastening element 280*c* is aligned with the fourth aperture 276*d*. In the illustrated embodiment, the inner end 290 of the fastening member 278 and the inner ends 332 of the plurality of fastening elements 280 are connected to the inner layer 388 of the upper 202 along the channel compartment 384 adjacent to the interior surface 252 of the upper 202. Further, the inner portion 296 of the fastening member 278 and the inner portions 338 of the plurality of fastening elements 280 are disposed within the channel compartment 384 while the central portion 300 of the fastening member 278 and the central portions 342 of the plurality of fastening elements 280 are adjacent the channel opening 386. In the illustrated embodiment, each of the fastening member 278 and the plurality of fastening elements 280 are rotatably attached to the inner layer 388 along the channel compartment 384 such that the fastening member 278 is rotatable within the channel 274 about the fastening member axis 294 and the plurality of fastening elements 280 are each rotatable within the channel 274 about the fastening element axes 336. In some embodiments, the fastening system 270 can be configured such that one or more of the fastening elements of the plurality of fastening elements 280 are slidable along the inner layer 388 within the channel compartment 384 toward one or both of the proximal and distal ends 392, 394 of the channel 274 along the channel axis 396. In some such embodiments, the one or more of the fastening elements of the plurality of fastening elements 280 can be both rotatable about the fastening axis 336 and slidable along the channel axis 396.

Referring now to FIGS. 9 and 10, the fastening system 270 of the article of footwear 200 is configured to be moveable between an initial or loosened configuration (as shown in FIG. 9), in which the wire 380 has a first tension, and a tightened configuration (as shown in FIG. 10), in which the wire 380 has a second tension that is greater than the first tension. More specifically, in the illustrated embodiment, the plurality of fastening elements 280 are configured to be simultaneously rotated about the fastening element axis 336 (see FIG. 8) between a first or loosened position (as shown in FIG. 9) and a second or tightened position (as shown in FIG. 10) via rotation of the fastening member 278 about the fastening member axis 294 (see FIG. 8) in either of the first or second directions 304, 306.

As discussed herein, the fastening system 270 is configured such that the geometric shapes of the plurality of apertures 276 of the channel 274 are generally similar to the geometric shapes of at least the second outer perimeters 346 of the plurality of fastening elements 280 and the second outer perimeter 310 of the fastening member 278. Thus, when the fastening system 270 is in the loosened configuration (as shown in FIG. 9), the plurality of fastening elements 280 are in the loosened position, in which the longitudinal axes 348 of the plurality of fastening elements 280 are substantially parallel to the channel longitudinal axis 396. With the plurality of fastening elements 280 in the loosened position (as shown in FIG. 9), the second outer perimeters 346 of the first, second, and third fastening elements 280*a*, 280*b*, 280*c* are aligned with the second, third, and fourth apertures 276*b*, 276*c*, 276*d* of the channel opening 386, respectively, such that at least the outer portions 340 of the first, second, and third fastening elements 280*a*, 280*b*, 280*c* are moveable within the second, third, and fourth apertures 276*b*, 276*c*, 276*d*, respectively.

In the illustrated embodiment of FIGS. 4-10, the fastening system 270 is moveable between the loosened configuration (as shown in FIG. 9) and the tightened configuration (as shown in FIG. 10) by rotation of the fastening member 278 in the first direction 304. In particular, when the fastening member 278 is rotated in the first direction 304 about the fastening member axis 294, the plurality of fastening elements 280 are caused to simultaneously rotate in the first direction 304 from the loosened position (as shown in FIG. 9) to the tightened position (as shown in FIG. 10), in which the longitudinal axes 348 of the plurality of fastening elements 280 are substantially perpendicular to the channel longitudinal axis 396. When the fastening member 278 rotates in the first direction 304, the first opening 312 of the fastening member 278 rotates toward the first fastening element 280*a* while the second opening 316 rotates away from the first fastening element 280*a*, which results in the plurality of fastening elements 280 being pulled and rotated by the wire 380 at the first openings 354.

More specifically, the first fastening element 280*a* is pulled by the wire 380 at the first opening 354, which causes the first fastening element 280*a* to rotate in the first direction 304 about the fastening element axis 336 toward the tightened position. As the first fastening element 280*a* rotates in the first direction 304, the wire 380 connected to or within both the third opening 362 of the first fastening element 280*a* and the first opening 354 of the second fastening element 280*b* further causes the second fastening element 280*a* to rotate in the first direction 304 toward the tightened position. As the second fastening element 280*b* rotates in the first direction 304, the wire 380 further connected to or within both the third opening 362 of the second fastening element 280*b* and the first opening 354 of the third fastening element 280*c* further causes the third fastening element 280*c* to rotate in the first direction 304 toward the tightened position.

Referring specifically to FIG. 10, with the plurality of fastening elements 280 in the tightened positions (as shown in FIG. 10) and at least the outer portions 346 received within the plurality of apertures 276, the second outer perimeters 346 of the outer portions 340 of the first, second, and third fastening elements 280*a*, 280*b*, 280*c* are misaligned with the second, third, and fourth apertures 276*b*, 276*c*, 276*d* of the channel opening 386, respectively, such that at least the outer portions 340 of the first, second, and third fastening elements 280*a*, 280*b*, 280*c* are not moveable within the second, third, and fourth apertures 276*b*, 276*c*, 276*d*, respectively. Further, inner surfaces (see FIG. 8) of the outer portions 340 of the first, second, and third fastening elements 280*a*, 280*b*, 280*c* in the tightened position contact the exterior surface 254 of the upper 202 adjacent to the respective second, third, and fourth apertures 276*b*, 276*c*, 276*d*. In addition, with the plurality of fastening elements 280 in the tightened position, the wire 380 has the second tension as the wire 380 is wrapped at least partially around the central portion 300 of the fastening member 278 and the central portions 342 of the plurality of fastening elements 280. With the wire 380 having the second tension, the fastening mechanism 272 and the plurality of fastening elements 280 that are rotatably attached to the inner layer 388 (see FIG. 8) of the upper 202 pull the lateral side 216 and the medial side 218 of the upper 202 inward, toward the channel 274 and further pull the instep region 258 downward, toward the sole structure 204 (see FIG. 4).

In addition, when the fastening system 270 is in the tightened configuration, the plurality of fastening elements 280 are pulled along the longitudinal channel axis 396 toward the fastening member 278 by the wire 380 having the second tension. For example, as shown in FIG. 9, with the fastening system 270 in the loosened configuration and the wire 380 having the first tension, the fastening mechanism 272 has a first overall length L1 measured from the fastening element longitudinal axis 348 of the third fastening element 280*c* to the fastening member axis 294 of the fastening member 278. As shown in FIG. 10, with the fastening system 270 in the tightened configuration and the wire 380 having the second tension, the fastening mechanism 272 has a second overall length L2 that is less than the first overall length L1 as the wire 380 pulls each of the plurality of fastening elements 280 toward the fastening member 278. With the tensioning mechanism 272 having the second overall length L2 and the plurality of fastening elements 280 attached to the interior surface 252 of the upper 202, the upper 202 is further tightened around a user's foot disposed within the interior cavity 206 of the upper 202 (see FIG. 4).

It is contemplated that at least the fastening member 278 of the fastening mechanism 272 can include a fastening holding mechanism (not shown) that is configured to releasably hold the plurality of fastening elements 280 in the tightened position (as shown in FIG. 10) and, thus, hold the fastening system 270 in the tightened configuration (as shown in FIG. 10). In some embodiments, a fastening holding mechanism can be arranged between the inner and central portions 296, 300 of the fastening member 278 and can be configured to releasably hold at least the central portion 300 in position relative to the inner portion 296 and/or the inner layer 388 of the upper 202 along the channel compartment 384. In other embodiments, a tension holding mechanism can be arranged along portions of the channel compartment 384 of the channel 274 and the first outer perimeter 308 of the inner portion 296 of the fastening member 278 and can be configured to releasably hold the entire fastening member 278 in position relative to the inner layer 388 of the upper 202 along the channel compartment 384.

In some embodiments, a tension holding mechanism can be a ratcheting system comprising a plurality of teeth arranged along an upper surface of the inner portion 296 adjacent to the central portion 300 and one or more pivoting pawls arranged on an inner surface of the central portion 300, or vice versa, that is configured to releasably engage the plurality of teeth of the inner portion 296 of the fastening member 278. In such embodiments, the one or more pivoting pawls of the ratcheting system can be pivotable via a lever or button (not shown) arranged on the outer portion 298 of the fastening member 278 or elsewhere along the upper 202 of the article of footwear 200 and/or via the fastening protrusion 302. In some embodiments, the fastening system 270 can be configured such that one or both of the fastening member 278 and the plurality of fastening members 280 are biased, such as, e.g., by a spring, toward the loosened positions or the tightened positions.

Referring again to FIGS. 9 and 10, the fastening system 270 is moveable from the tightened configuration (as shown in FIG. 10) back to the loosened configuration (as shown in FIG. 9) by rotation of the fastening member 278 in the second direction 306. When the fastening member 278 rotates in the second direction 306, each of the plurality of fastening elements 280 are caused to simultaneously rotate in the second direction 306 from the tightened position (as shown in FIG. 10) back to the loosened position (as shown in FIG. 9). In some embodiments, the fastening mechanism 272 can be configured such that the fastening member 278 can be rotated in the first direction 304 about the fastening member axis 294 to about 45 degrees from a first or initial position (as shown in FIG. 9) to move the fastening system 270 from a loosened configuration, in which the wire 380 has a first tension, to a first tightened configuration, in which the wire 380 has a second tension that is greater than the first tension. In such embodiments, with the fastening member 278 in the first tightened configuration, the fastening member 278 can be further rotated in the first direction 304 about the fastening member axis 294 to about 90 degrees from the first position to move the fastening system 270 from the first tightened configuration to a second tightened configuration, in which the wire 380 has a third tension that is greater than the first tension and the second tension. In some embodiments, the fastening mechanism 272 can be configured to have at least three tightened configurations.

It is contemplated that the fastening system 270 of the article of footwear 200 can be configured to automatically move between the loosened configuration and the tightened configuration via one or more user inputs in addition to, or instead of, rotation of the fastening member 278 by the user. For example, in some embodiments, the fastening system 270 can include an electrical actuator (not shown) configured to move the fastening system 270 between the loosened and tightened configurations and a controller (not shown) configured to control the electrical actuator. In some such embodiments, the controller of the fastening system 270 can be configured to control the electrical actuator based on one or more user inputs received by the controller, such as, e.g., a button press, a swipe, or an electronic input from a wireless device in wireless communication with the controller.

In such embodiments, a pair of footwear including the article of footwear 200 with the fastening system 270 can be simultaneously moved between the loosened configuration and the tightened configuration via a user input on a single wireless device that is simultaneously received by controllers of each of the pair of footwear. In some such embodiments, the fastening system 270 can further include one or more sensors (not shown) that can be configured to sense when a user's foot is inserted within the interior cavity 206 of the upper 202, such as, e.g., a proximity sensor or a pressure sensor, and the controller can be configured to, in response to signals received from the one or more sensors indicating the presence of the user's foot, automatically command the electrical actuator to move the fastening mechanism 272 from the loosened configuration to the tightened configuration.

In some such embodiments, the controller of the fastening system 270 can be further configured to command the electrical actuator to move the fastening mechanism 272 from the loosened configured to one of a plurality of tightened configurations in response to one or more user inputs corresponding to incremental levels of tightening of the article of footwear 200. In some such embodiments, the fastening system 270 can further include a battery (not shown) configured to power the controller and the electrical actuator. In some such embodiments, the battery of the fastening system 270 can be disposed at least partially within the sole structure 204 or arranged along the upper 202, such as, e.g., on the proximal end 222 (see FIG. 4) of the upper 202.

In some embodiments, the fastening member 278 can be configured as the electrical actuator (not shown) of the fastening system 270. In other embodiments, the electrical actuator of the fastening system 270 can comprise an electrical motor and a gear system (not shown). In such embodiments, the gear system can be in mechanical communication with at least the fastening member 278 and the motor can be configured to rotate the fastening member 278 in the first or second directions 304, 306 via the gear system. In some embodiments, the gear system of the fastening system 270 can be configured to hold the fastening member 278 in at least the tightened position. In such embodiments, the gear system and the motor of the fastening system 270 can be configured to permit rotation of the fastening member 278 by a user in addition to, or alternative to, user inputs received by the controller.

In some embodiments, the fastening system 270 can further include one or more lighting elements (not shown), e.g., a light-emitting diode (LED), and the controller can be further configured to control the one or more lighting elements to provide visual indications that can correspond to one or more characteristics of the fastening system 270, such as, e.g., a present tightness level of the fastening mechanism 272, a battery level of the battery, etc., or one or more dynamic characteristics of the article of footwear 200. In such embodiments, the one or more lighting elements can be arranged on the fastening member 278 and/or on one or more of the plurality of fastening elements 280 such that the one or more lighting elements are visible from an exterior of the article of footwear 200, including to a user wearing the article of footwear 200. For example, in such embodiments, at least the outer portion 298 of the fastening member 278 and/or the outer portions 340 of the fastening elements 280 can comprise a translucent or transparent material and the one or more lighting elements of the fastening system 270 can be disposed within the fastening member 278 and/or the fastening elements 280.

It is further contemplated that the connecting element 282 of the fastening mechanism 272 of the fastening system 270 can have other configurations or structures. In some embodiments, the connecting element 282 of the fastening mechanism 272 can be an interconnected substrate disposed on the inner layer 388 of the upper 202 along the channel compartment 384 (see FIG. 8), with the plurality of fastening elements 280 and the fastening member 278 being attached thereto. In such embodiments, the substrate can be configured such that the fastening member 278 and each of the plurality of fastening elements 280 are connected to a respective substrate portion. The plurality of substrate portions can be configured such that when the plurality of fastening elements 280 are in the loosened position (as shown in FIG. 9), the plurality of substrate portions do not contact one another, and when the plurality of fastening elements 280 are rotated to the tightened position (as shown in FIG. 10) via rotation of the fastening member 278, the plurality of substrate portions contact each other and provide tension along the upper 202 (see FIG. 4). In some embodiments, the interconnected substrate can comprise a material having elastomeric properties. In some embodiments, at least a portion of the inner layer 388 of the upper 202 can be the interconnected substrate. In some embodiments, the upper 202 can be configured such that the interconnected substrate is visible from an exterior of the article of footwear 200. For example, in such embodiments, at least a portion of the outer layer 390 (see FIG. 8) of the upper 202 adjacent to the channel opening 386 of the channel 274 can comprise a material having translucent or transparent properties.

It is further contemplated that the fastening system 270 of the article of footwear 200 can include a plurality of fastening mechanisms arranged at various locations of the upper 202. For example, referring again to FIG. 4, the fastening system 270 of the article of footwear 200 can include a first channel and a first fastening mechanism arranged on the lateral side 216 of the upper 202, for example, similar to the fastening mechanism 272 disposed within the channel 274, and a second channel and a second fastening mechanism arranged on the medial side (not shown) of the upper 202 that is configured similar to the first channel and the first fastening mechanism. In such embodiments, with the first and second fastening mechanisms each in a tightened configuration, the instep region 258 of the upper 202 is pulled symmetrically downward toward the sole structure 204 from the lateral side 216 and the medial side (not shown).

It is further contemplated that the fastening system 270 of the article of footwear 200 can include one or more support elements, such as, e.g., a strap, a lace, or a wing, that can extend from the sole structure 204 to the fastening mechanism 272. For example, in some embodiments, a first or lateral support element can extend from the sole structure 204 along the lateral side 216 of the upper 202 to the channel 274 and a second or medial support element can extend from the sole structure 204 along the medial side (not shown) of the upper 202 and across the instep region 258 to the channel 274. In such embodiments, the first and second support elements can be connected to the fastening mechanism 272 such that at least the second support element is pulled across the instep region 258 toward the lateral side 216 of the sole structure 204 when the fastening system 270 is in the tightened configuration and provides support along the instep region 258. In other embodiments, one or more support elements of the fastening system 270 can be coupled to the plurality of fastening elements 280 such that the one or more support elements are tensioned directly by the plurality of fastening elements 280 when the fastening mechanism 272 is in the tightened configuration.

Figure 11:
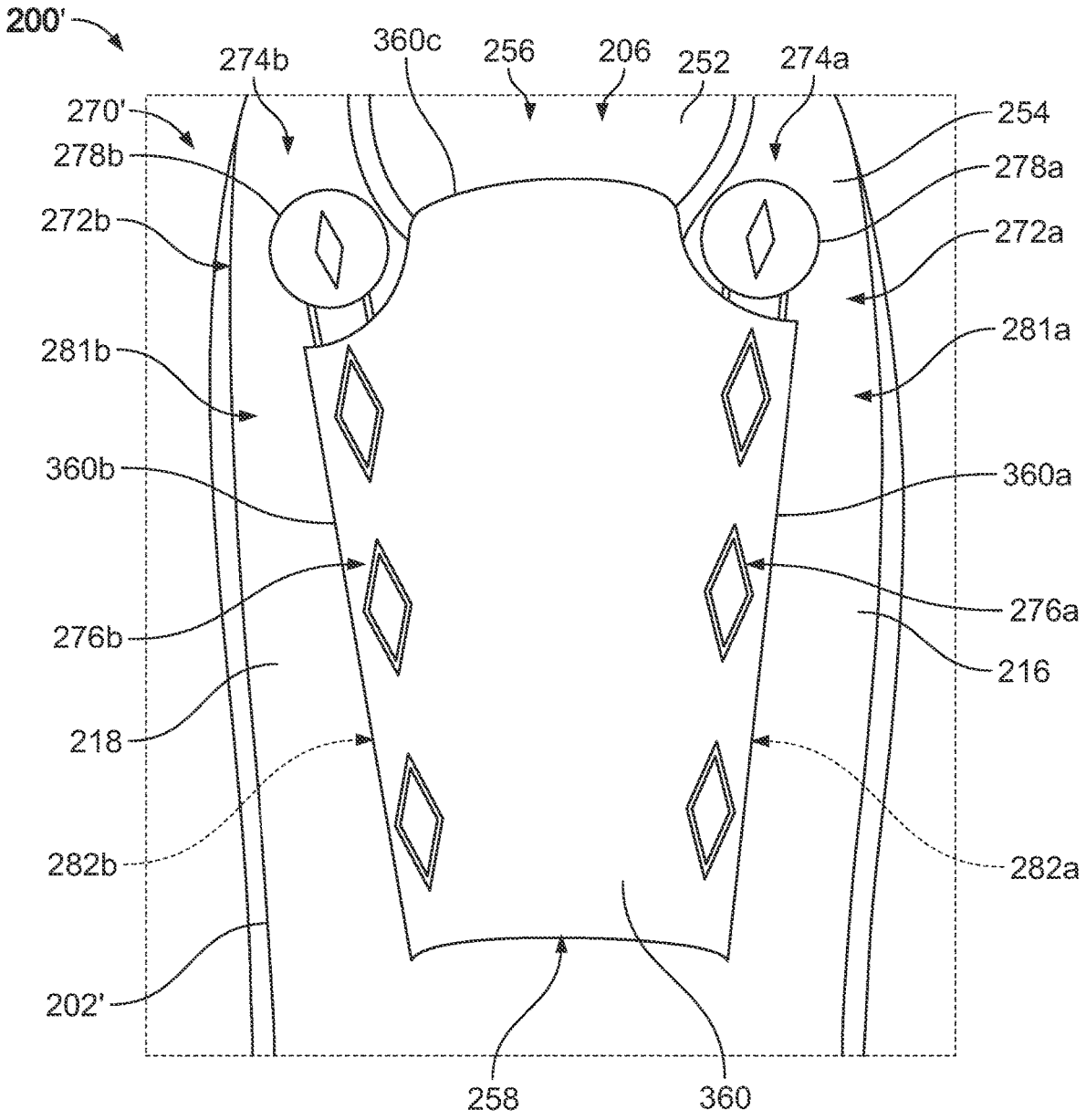
FIG. 11 is a front, top perspective detail view of an alternative embodiment of the fastening system and upper of the article of footwear of FIG. 4 with the fastening system in a loosened configuration.
Figure 12:
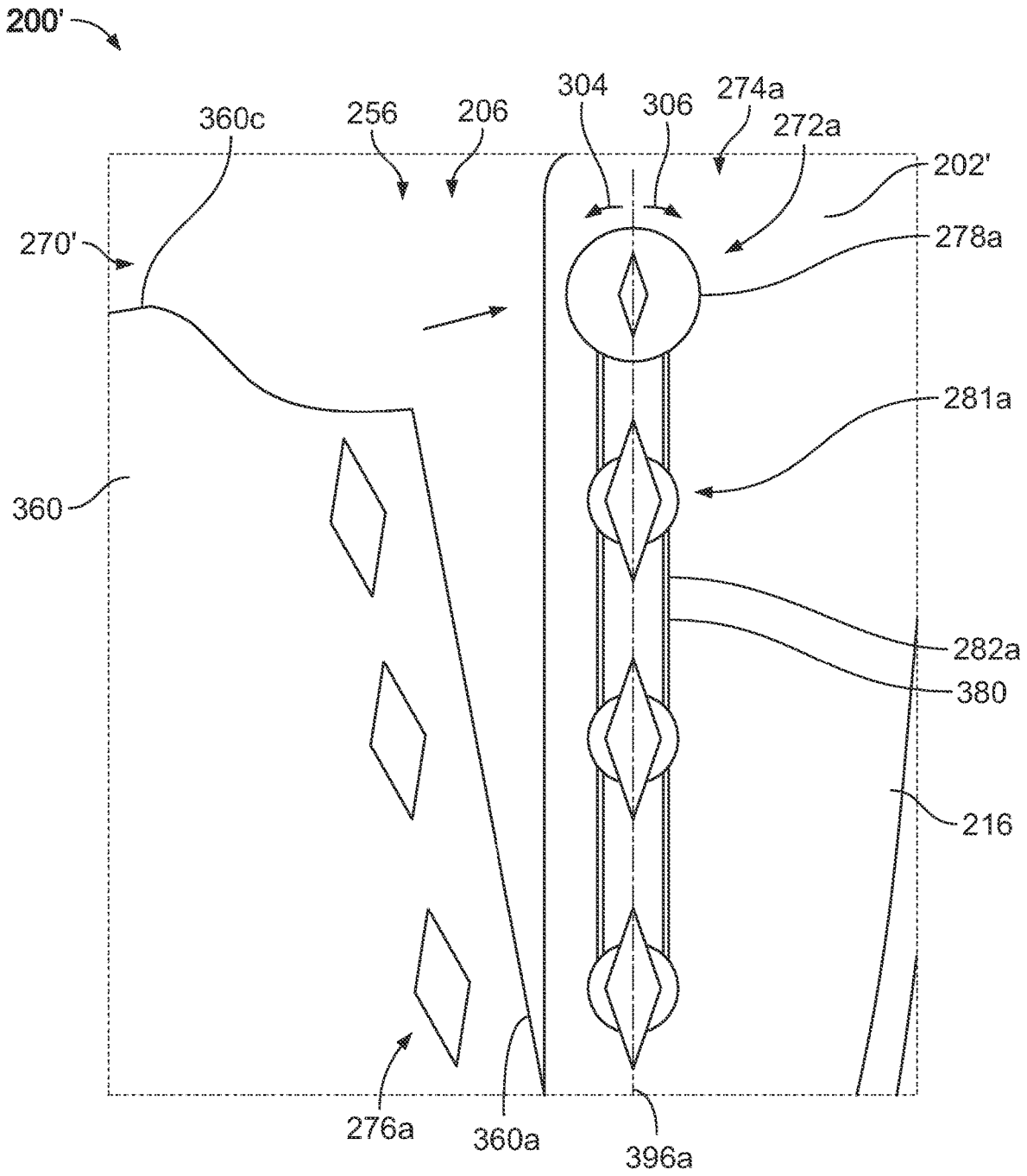
FIG. 12 is a lateral top side perspective detail view of the fastening system of FIG. 11.
Figure 13:
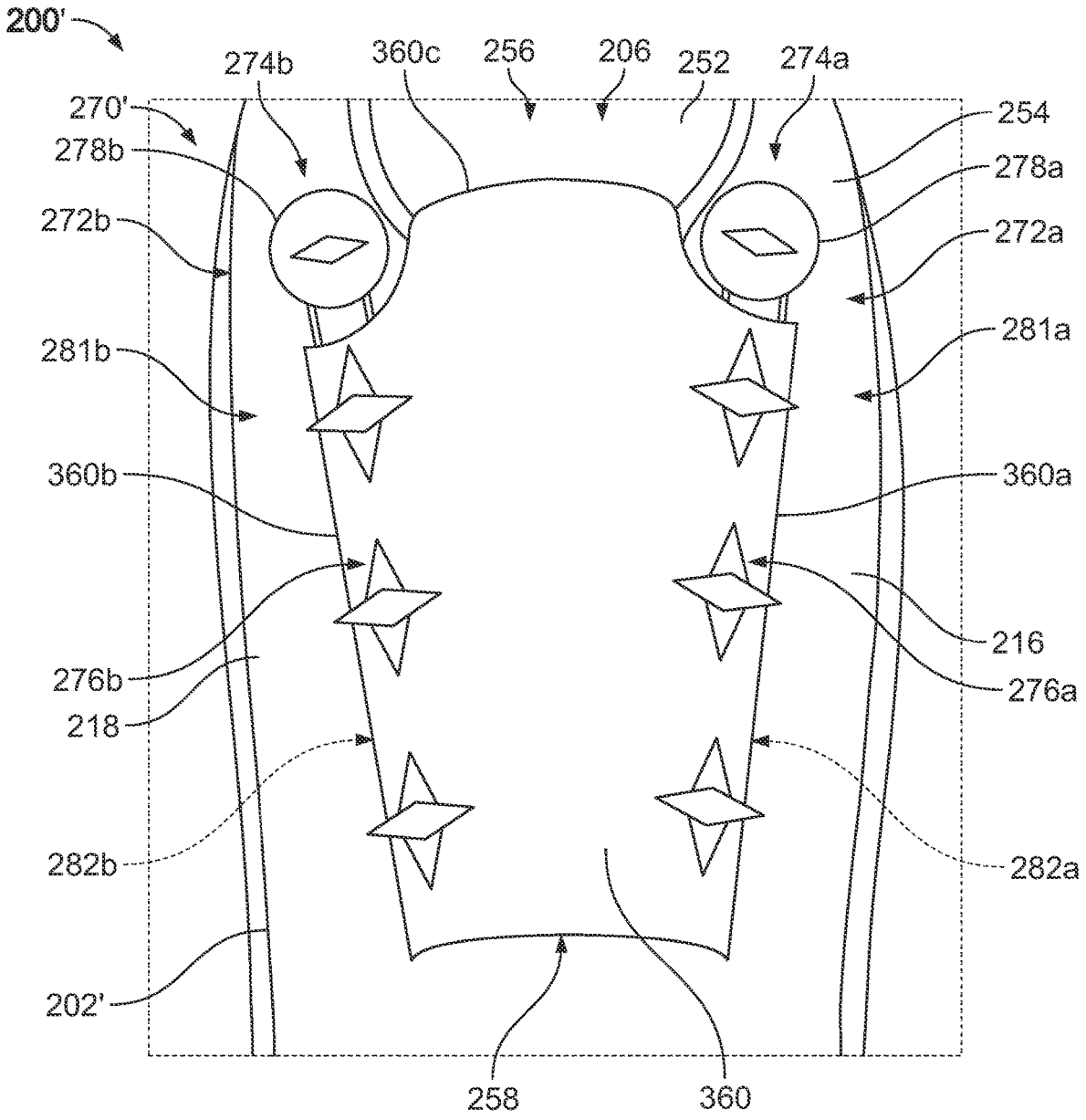
FIG. 13 is a front top side perspective detail view of the article of footwear of FIG. 11 with the fastening system in a tightened configuration.

It is still further contemplated that the fastening system 270 of the article of footwear 200 can be implemented on the upper 202 to secure or release a tongue of the upper 202. In this regard, FIGS. 11-13 depict an another exemplary embodiment of an article of footwear 200' having a fastening system 270' and an upper 202', in which the upper 202' includes a tongue 360 extending along the instep region 258 of the upper 202' between the lateral and medial sides 216, 218 of the upper 202'. In the illustrated embodiment, the fastening system 270' is configured to be moveable between a loosened configuration (as shown in FIGS. 11 and 12), in which the tongue 360 is moveable away from the sole structure 204 (see FIG. 4), and a tightened configuration (as shown in FIG. 13), in which the tongue 360 is pulled inward, toward the sole structure 204 (see FIG. 4) and is retained relative to the upper 202'. In particular, a first or lateral fastening mechanism **272*a* is arranged on the lateral side 216 of the upper 202' adjacent to a first or lateral side 360*a* of the tongue 360 and a second or medial fastening mechanism 272*b* is arranged on a medial side 218 of the upper 202' adjacent to a second or medial side 360*b* of the tongue 360**.

Referring specifically to FIG. 11, the lateral fastening mechanism **272*a* includes a first or lateral fastening member 278*a* arranged along the lateral side 216 the upper 202' adjacent to both the opening 256 of the upper 202' and a third or top end 360*c* of the tongue 360. The lateral fastening mechanism 272*a* further includes a first or lateral plurality of fastening elements 281*a* extending from the lateral fastening member 278*a* adjacent to the lateral side 360*a* of the tongue 360 and toward the distal end 224 (see FIG. 4) of the upper 202' along a first fastening mechanism longitudinal axis 396*a* (see FIG. 12). Likewise, the medial fastening mechanism 272***b* includes a second or medial fastening member 278*b* arranged along the medial side 218 of the upper 202' adjacent to both the opening 256 of the upper 202' and the top end 360*c* of the tongue 360. The medial fastening mechanism 272*b* further includes a second or medial plurality of fastening elements 281*b* extending from the medial fastening member 278*b* adjacent to the medial side 360*b* of the tongue 360 and toward the distal end 224 (see FIG. 4) of the upper 202' along a second fastening mechanism longitudinal axis (not shown).

Still referring to FIG. 11, the tongue 360 defines both a first or lateral plurality of apertures 276*a* disposed adjacent to the lateral side 360*a* and a second or medial plurality of apertures 276*b* disposed adjacent to the medial side 360*b*. In other words, the lateral side 360*a* of the tongue 360 and the lateral side 216 of the upper 202' form a first or lateral channel 274*a* of the fastening system 270' and the medial side 360*b* of the tongue 360 and the medial side 218 of the upper 202*a* form a second or medial channel 274*b* of the fastening system 270'. The lateral and medial channels 274*a*, 274*b* include an inner portion (not shown) formed by the upper 202', e.g., between the inner and outer surfaces of the upper 202', and an outer portion (not shown) formed by the tongue 360, e.g., an outer surface of the tongue 360 along the lateral and medial sides 360*a*, 360*b*. Thus, the lateral and medial pluralities of apertures 276*a*, 276*b* are arranged on the outer portions (not shown) of the respective lateral and medial channels 274*a*, 274*b* while the lateral and medial fastening mechanisms 272*a*, 272*b* are arranged on or within the inner portions of the respective lateral and medial channels 274*a*, 274*b*.

Referring specifically to FIG. 12, with the lateral and medial fastening mechanisms 272*a*, 272*b* in a first or unfastened position (as shown in FIGS. 11 and 12) and thus, the fastening system 270' in the loosened configuration, the lateral and medial pluralities of apertures 276*a*, 276*b* of the tongue 360 are receivable, but not engaged, by the lateral and medial pluralities of fastening elements 281*a*, 281*b* of the lateral and medial fastening mechanisms 272*a*, 272*b*, respectively. Thus, with the fastening system 270' in the loosened configuration (as shown in FIG. 12), the tongue 360 is freely moveable or rotatable relative to the upper 202' away from the opening 256 of the upper 202' or the sole structure 204 (see FIG. 4) of the article of footwear 200' such that the lateral and medial pluralities of apertures 276*a*, 276*b* of the tongue 360 can disengage the lateral and medial pluralities of fastening elements 281*a*, 281*b* entirely.

Referring now to FIG. 13, with the lateral and medial pluralities of fastening elements 281*a*, 281*b* of the lateral and medial fastening mechanisms 272*a*, 272*b* received within the corresponding lateral and medial pluralities of apertures 276*a*, 276*b* of the tongue 360, the fastening system 270' can be moved to the tightened configuration by rotation of the lateral and medial pluralities of fastening elements 281*a*, 281*b* to a second or fastened position (as shown in FIG. 13). With the lateral and medial pluralities of fastening elements 281*a*, 281*b* in the fastened position, the lateral and medial pluralities of fastening elements 281*a*, 281*b* engage the corresponding lateral and medial pluralities of apertures 276*a*, 276*b* such that the tongue 360 is pulled downward, toward the sole structure 204 (see FIG. 4) of the article of footwear 200' and is secured or retained relative to the upper 202' adjacent to the opening 256 of the upper 202'.

In some embodiments, the fastening system 270' can be configured such that the lateral and medial pluralities of fastening elements 281*a*, 281*b* are moveable between the unfastened position and the fastened position by rotation of a single fastening member that is operatively connected to both of the lateral and medial pluralities of fastening elements 281*a*, 281*b* via two or more connecting elements. For example, in some such embodiments, a single fastening member can be arranged on the upper 202', such as, e.g., one of the lateral side 216, the medial side 218, the proximal end 222, or the distal end 224 (see FIG. 4) thereof, and operatively connected to each of the lateral and medial pluralities of fastening elements 281*a*, 281*b*. In some embodiments, one or both of the lateral and medial fastening mechanisms 272*a*, 272*b* can be arranged on the tongue 360, such as, e.g., an underside of the tongue 360, and one or both of the lateral and medial pluralities of apertures 276*a*, 276*b* can be defined on the lateral and medial sides 216, 218, respectively, of the upper 202'.

It is further contemplated that the fastening system 270' of the article of footwear 200' can further include one or more support elements, such as, e.g., a strap or lace, that can extend across the instep region 258 of the upper 202' into each of the first and second channels and in connection with each of the first and second fastening mechanisms, such that the first and second fastening mechanisms are pulled toward each other by the one or more support elements when at least one of the first or second fastening mechanisms are in the tightened configuration. In some such embodiments, the one or more support elements can extend along the exterior surface 254 of the upper 202' over the instep region 258. In some embodiments, the one or more support elements can extend across a tongue 360 of the upper 202' between the first and second fastening mechanisms. In some embodiments, the one or more support elements can include a first support element extending from the lateral side 216 of the sole structure 204 to the first fastening mechanism and a second support element extending from the medial side (not shown) of the sole structure 204 to the second fastening mechanism. In some such embodiments, the one or more support elements can further include a third support element extending across the instep region 258 of the upper 202' that may or may not be connected to one or both of the first and second support elements.

Referring to FIGS. 4-13, various components of the example article of footwear 200, 200', including one or more components or structures of the fastening system 270, 270', may be formed through additive manufacturing techniques, such as 3D printing. To that end, a number of 3D printing techniques may be implemented to form the article of footwear 200 having the fastening system 270, 270', such as vat photopolymerization, material jetting, binder jetting, powder bed fusion, material extrusion, directed energy deposition, and/or sheet lamination. In some embodiments, the fastening mechanism 272 may be 3D printed as a single unitary piece. In other embodiments, at least the inner portions 296, 338 of the fastening member 278 or the plurality of fastening elements 280 may be 3D printed within the channel compartment 384 of the upper 202, 202' separate from and later coupled to the outer or central portions 298, 300, 340, 342. In some embodiments, one or more portions of the fastening member 278 or the plurality of fastening elements 280 may be 3D printed with a first material and other portions of the fastening member 278 or the plurality of fastening elements 280 may be 3D printed with a second material.

Figure 14:
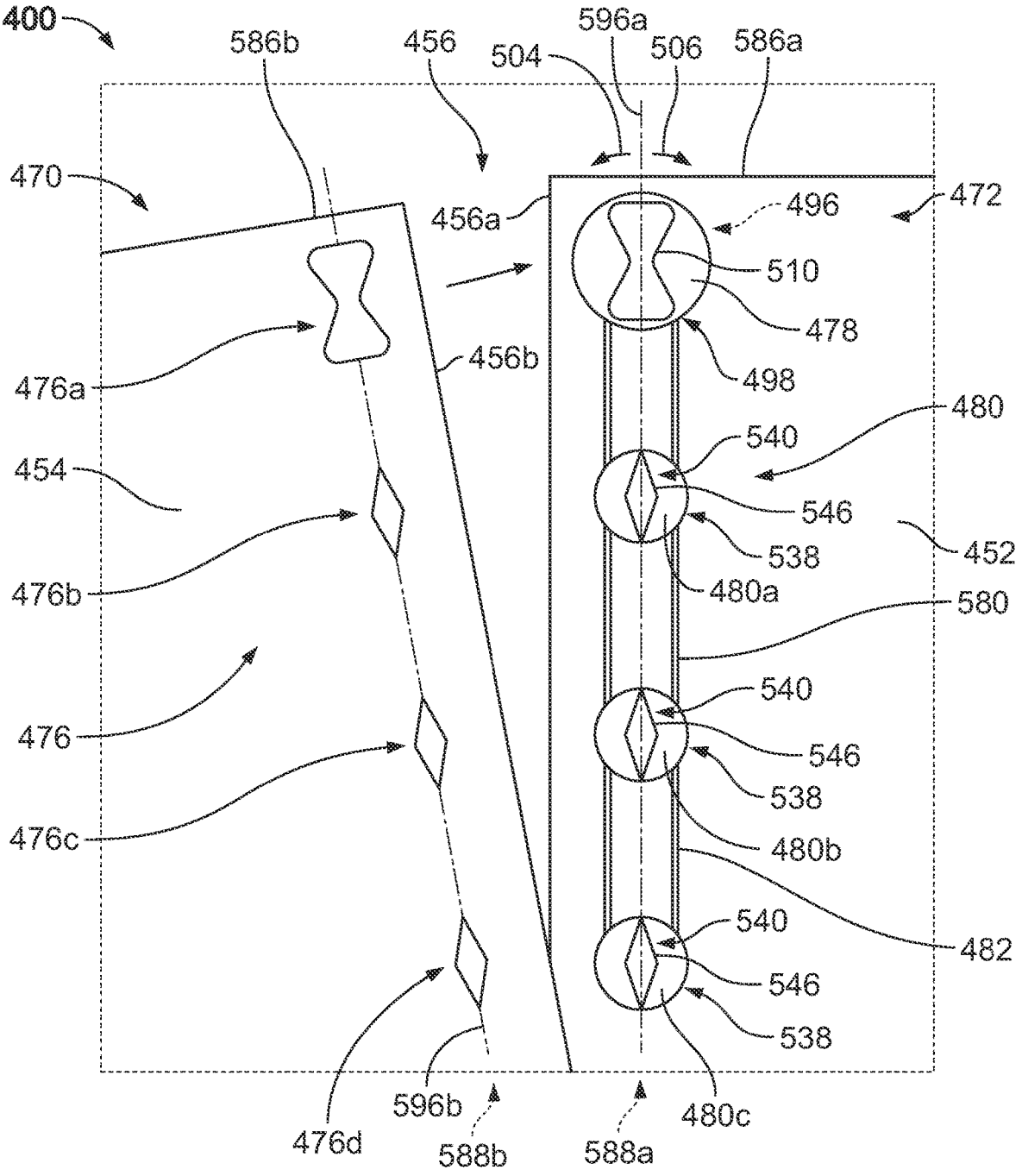
FIG. 14 is a front view of an article having a fastening system, according to another embodiment of the disclosure, with the fastening system in a loosened configuration.
Figure 15:
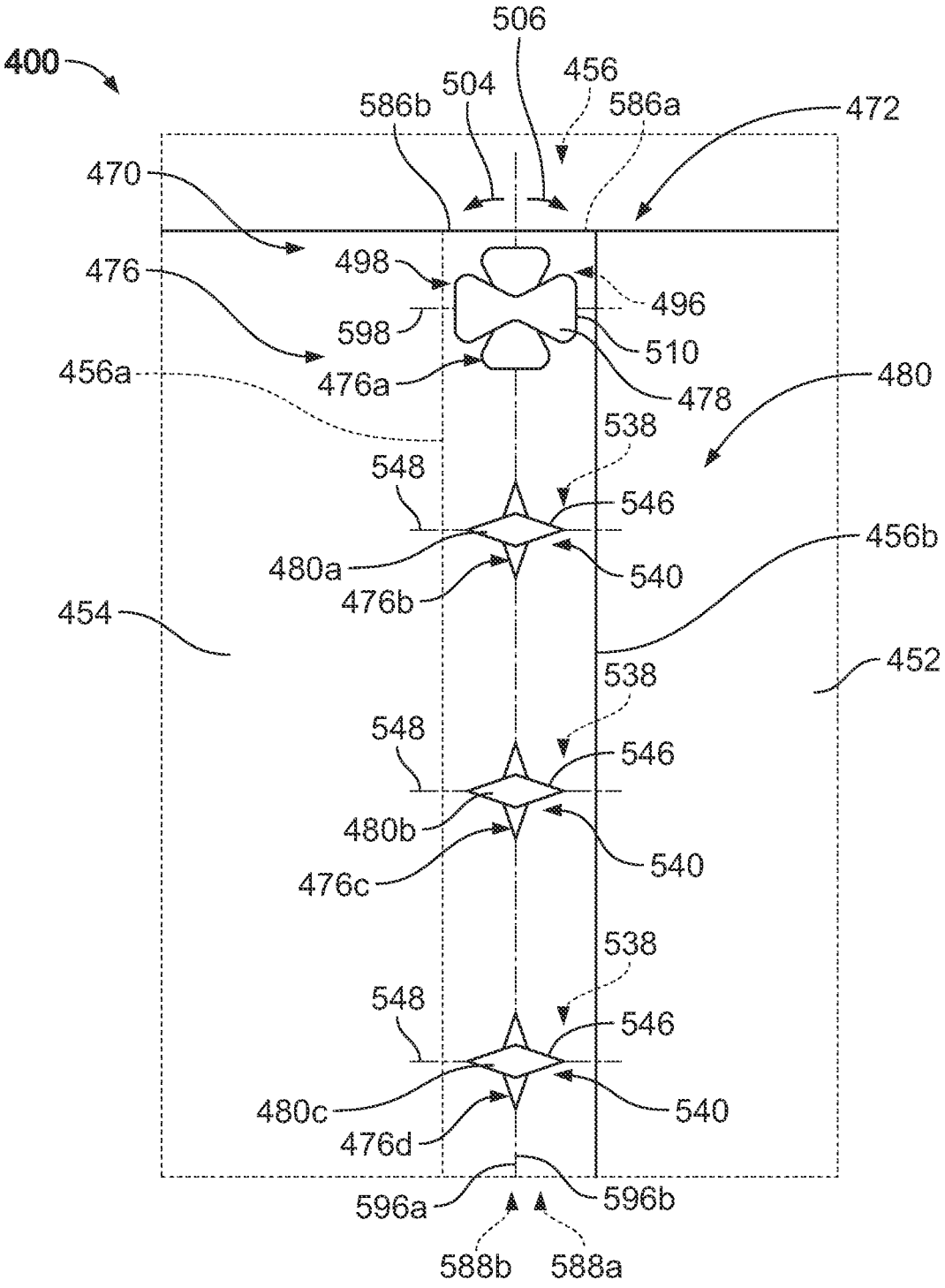
FIG. 15 is a front view of the article of FIG. 14 with the fastening system in a tightened configuration.

It is contemplated that aspects of the fastening systems 270, 270' can be incorporated on articles different than the article of footwear 200, 200', such as, e.g., an article of clothing, a glove, a bag, etc. Referring now to FIGS. 14 and 15, an exemplary embodiment of an article 400 is depicted, which includes a fastening system 470 with a fastening mechanism 472. The fastening system 470 is similar to the fastening system 270 of the article of footwear 200, with like elements being indicated by similar reference numerals under the "4xx series" and "5xx series" of reference numerals. For example, the fastening mechanism 472 of the fastening system 470 includes a fastening member 478 operatively engaged with a plurality of fastening elements 480 via a connecting element 482 in a similar manner as the fastening mechanism 272 of the fastening system 270 of FIGS. 4-10 having the fastening member 278, the plurality of fastening elements 280, and the connecting element 282.

While the fastening system 470 of the article 400 is similar to the fastening system 270 of the article of footwear 200 in many aspects, there are some aspects that differ. In particular, the fastening mechanism 472 of the fastening system 470 is arranged on a first fastening portion 452 of a fastening opening 456 of the article 400 and is configured to be moveable between a first or unfastened position (as shown in FIG. 14) and a second or fastened position (as shown in FIG. 15) to engage a plurality of apertures 476 disposed on a second fastening portion 454 of the fastening opening 456. Thus, the fastening system 470 is moveable between a loosened or unfastened configuration (as shown in FIG. 14), in which the second fastening portion 454 is moveable relative to the first fastening portion 452, and a tightened or fastened configuration (as shown in FIG. 15), in which the second fastening portion 454 is secured to the first fastening portion 452 to close the fastening opening 456.

Referring to FIG. 14, in the illustrated embodiment, the fastening mechanism 472 of the fastening system 470 is arranged on the first fastening portion 452 such that the fastening member 478 is rotatably attached to the first fastening portion 452 adjacent to both a first or upper end 586*a* and a first opening edge 456*a* of the first fastening portion 452. The plurality of fastening elements 480 are rotatably attached to the first fastening portion 452 and arranged in a line and spaced from the fastening member 478 along a fastening mechanism longitudinal axis 596*a* extending from the fastening member 470 toward a second or lower end 588*a*, opposite the upper end 586*a*, of the first fastening portion 452. In the illustrated embodiment, the plurality of fastening elements 480 includes a first or upper fastening element 480*a* arranged adjacent to the fastening member 478, a second or middle fastening element 480*b* arranged adjacent to the first fastening element 480*a*, and a third or lower fastening element 480*c* arranged adjacent to the second fastening element 480*b*. In other words, the plurality of fastening elements 480 are arranged in series from the fastening member 478 along the first fastening portion 452. In some embodiments, the plurality of fastening elements 480 can include two or four or more fastening elements operatively connected to the fastening member 478. In some embodiments, the plurality of fastening elements 480 can include a first plurality of fastening elements and a second plurality of fastening elements having different properties, e.g., shapes, colors, and materials, than the first plurality of fastening elements.

Referring still to FIG. 14, in the illustrated embodiment, the connecting element 482 is a wire 580 that is connected to the fastening member 478 and each of the plurality of fastening elements 480. In particular, the wire 580 is connected to first and second openings (not shown) extending into a first or inner portion 496 of the fastening member 478, e.g., similar to the first and second openings 312, 316 of the fastening member 278 of fastening mechanism 272 (see FIG. 5), and also connected to first, second, third, and fourth openings (not shown) extending into first or inner portions 538 of the plurality of fastening elements 480, e.g., similar to the openings 354, 358, 362, 366 of the plurality of fastening elements 280 of the fastening mechanism 272 (see FIG. 5). In some embodiments, the wire 580 is fixedly attached to the fastening member 478 and the plurality of fastening elements 480. In some embodiments, the wire 580 is slidably connected to the fastening member 478 and/or the plurality of fastening elements 480. In some embodiments, the wire 580 is fixedly attached to or within first and third openings (not shown) and to or within second and fourth openings (not shown) of at least the first and second fastening elements 480*a*, 480*b*. In some embodiments, the connecting element 482 can comprise a plurality of wires. In some embodiments, the wire 580 can be slidably received with one or more wire channels formed on the first fastening portion 452 of the article 400.

With continued reference to FIG. 14, the plurality of apertures 476 are arranged along an aperture longitudinal axis 596*b* extending adjacent to a first or upper end 586*b* of the second fastening portion 454 toward a second or lower end 588*b*, opposite the first end 586*b*, and adjacent to second opening edge 456*b* of the second fastening portion 454. In the illustrated embodiment, the plurality of apertures 476 of the second fastening portion 454 includes a first or upper aperture 476*a*, a second or mid-upper aperture 476*b*, a third or mid-lower aperture 476*c*, and a fourth or lower aperture 476*d*. Thus, the plurality of apertures 476 are arranged such that the fastening member 478 and the plurality of fastening elements 480 disposed on the first fastening portion 452 are aligned with the plurality of apertures 476 when the second fastening portion 454 is moved adjacent to and overlapped with the first fastening portion 452, as shown in FIG. 15.

Still referring to FIG. 14, the first aperture 476*a* has a first geometric shape that is similar to a first geometric shape of a second outer perimeter 510 of a second or outer portion 498 of the fastening member 478. Likewise, the second, third and fourth apertures 476*b*, 476*c*, 476*d* have a second geometric shape that is similar to a second geometric shape of second outer perimeters 546 of outer portions 540 of each of the plurality of fastening elements 480. Thus, the plurality of apertures 476 are configured to receive at least the outer portion 498 of the fastening member 478 and the outer portions 540 of the plurality of fastening elements 480 when the second fastening portion 454 is overlapped with the first fastening portion 452 and with the fastening member 478 and the plurality of fastening elements 480 each in a first or unfastened position (as shown in FIG. 14). In the illustrated embodiment, the first geometric shape of the second outer perimeter 510 of the outer portion 498 of the fastening member 478 is an hourglass shape with opposing wider ends being aligned along a fastening member longitudinal axis 598, and the second geometric shape of the second outer perimeters 546 of the outer portions 540 of the plurality of fastening elements 480 is shaped as an elongated rhombus with two opposing end points being aligned along a fastening element longitudinal axis 548. In some embodiments, the first geometric shape of the fastening member 478 is similar to the second geometric shape of the plurality of fastening elements 480. In some embodiments, one or more of the plurality of fastening elements 480 can have a third geometric shape that is different than each of the first and second geometric shapes.

Still referring to FIGS. 14 and 15, and as mentioned above, the fastening system 470 of the article 400 is configured to be moveable between an initial loosened or unfastened configuration (as shown in FIG. 14) and a tightened or fastened configuration (as shown in FIG. 15). In particular, in the illustrated embodiment, the plurality of fastening elements 480 are configured to be simultaneously rotated between the first or unfastened position (as shown in FIG. 14) and a second or fastened position (as shown in FIG. 15) via the wire 580 (see FIG. 14) when the outer portion 498 of the fastening member 478 is rotated by a user in a first or a second direction 504, 506. When the fastening system 470 is in the unfastened configuration (as shown in FIG. 14), both the fastening member 478 and the plurality of fastening elements 480 are in the unfastened position with the longitudinal axis 598 of the outer portion 498 of the fastening member 478 and longitudinal axes 548 of the plurality of fastening elements 480 being substantially parallel to the fastening member axis 596*a*. With the fastening member 478 in the unfastened position (as shown in FIG. 14), the second outer perimeter 510 of the fastening member 478 can be aligned with the first aperture 476*a* such that at least the outer portion 498 of the fastening member 470 is moveable within the first aperture 476*a*. Likewise, with the plurality of fastening elements 480 in the unfastened position (as shown in FIG. 14), the second outer perimeters 546 of the plurality of fastening elements 480 can be aligned with the second, third, and fourth apertures 476*b*, 476*c*, 476*d*, such that at least the outer portions 540 of the plurality of fastening elements 480 are moveable within the second, third, and fourth apertures 476*b*, 476*c*, 476*d*.

Thus, with the fastening member 478 and the plurality of fastening elements 480 in the unfastened position (as shown in FIG. 14) and the outer portions 498, 540 of the fastening member 478 and the fastening elements 480, respectively, received within each of the corresponding plurality of apertures 476 of the second fastening portion 454, the fastening system 470 can be moved to the fastened configuration (as shown in FIG. 15) to secure the second fastening portion 454 to the first fastening portion 452. In particular, when the fastening member 278 is rotated in the first direction 504 from the unfastened position (as shown in FIG. 14) to the fastened position (as shown in FIG. 15), the plurality of fastening elements 480 are caused to simultaneously rotate in the first direction via the wire 580 (see FIG. 14) from the unfastened position (as shown in FIG. 14) to the fastened position (as shown in FIG. 15). As shown in FIG. 15, in the fastened positions, the longitudinal axis 598 of the fastening member 478 and the longitudinal axes 548 of the plurality of fastening elements 480 are substantially perpendicular to both the fastening mechanism axis 596*a* and the apertures axis 596*b*.

Referring specifically to FIG. 15, with the fastening member 478 and the plurality of fastening elements 480 in the fastened positions, the second outer perimeter 510 of the fastening member 478 and the second outer perimeters 546 of the plurality of fastening elements 480 are misaligned with the corresponding plurality of apertures 476, such that at least the outer portion 498 of the fastening member 478 and the outer portions 540 of the plurality of fastening elements 480 are secured within the plurality of apertures 476. In particular, an inner surface (not shown) of the outer portion 498 of the fastening member 478 and inner surfaces (not shown) of the outer portions 540 of the plurality of fastening elements 480 contact an outer surface of the second fastening portion 454 adjacent to the corresponding plurality of apertures 476. Thus, with the fastening system 470 in the fastened configuration (as shown in FIG. 15), the second fastening portion 454 is secured to the first fastening portion 452 by the fastening member 478 and the plurality of fastening elements 480 being in the fastened position and received within the plurality of apertures 476.

It is contemplated that at least one of the first and second fastening portions 452, 454 can include a cover to prevent the fastening mechanism 472 from undesirably contacting items external to the article 400 when the article 400 is worn by a user. In some embodiments, the first fastening portion 452 can include a fastening mechanism cover (not shown) that is configured to at least partially enclose the fastening mechanism 472 such that only the outer portion 498 of the fastening member 478 and the outer portions 540 of the plurality of fastening elements 480 are not enclosed by the fastening mechanism cover. In some embodiments, the second fastening portion 454 can include an aperture cover or flap (not shown) that is configured to at least partially cover the plurality of apertures 476 such that the outer portion 498 of the fastening member 478 and the outer portions 540 of the plurality of fastening elements 480 are not exposed on an external surface of the article 400 when the fastening mechanism 472 is in the fastened configuration, such as shown in FIG. 15. In some such embodiments, an aperture cover or flap of the second fastening portion 454 can comprise a translucent or transparent material. In some embodiments, the article 400 can be configured such that the fastening system 470 is arranged along an internal surface of the article 400 adjacent to a user and is not exposed to an external surface of the article 400, opposite the internal surface.

It is further contemplated that at least the first or second ends 586*a*, 586*b*, 588*a*, 588*b* of the first and second fastening portions 452, 454 of the article 400 can be connected. In some embodiments, the second ends 588*a*, 588*b* of the first and second fastening portions 452, 454 can be connected while the first ends 586*a*, 586*b* are not connected. In such embodiments, for example, the article 400 can be a pair of pants, e.g., trousers, sweatpants, shorts, etc., and the fastening opening 456 can be a fly portion of the pants arranged along a waistband of the pants or can be arranged at a bottom portion of a leg opening of the pants. In other such embodiments, the article can be a shirt, e.g., a "quarter-zip" sweater or sweatshirt, and the fastening opening 456 can be a head opening portion of the shirt adjacent to a user's neck. In some embodiments, the article 400 can be a glove, e.g., a golf glove, baseball glove, etc., and the fastening opening can be a portion of the glove adjacent to a user's wrist.

In some embodiments, both the first and second ends 586*a*, 586*b*, 588*a*, 588*b* of the first and second fastening portions 452, 454 can be connected. In such embodiments, for example, the article 400 can be a bag, e.g., a backpack, purse, duffle bag, etc., and the fastening opening 456 can be an opening into an interior compartment of the bag. In some embodiments, the first and second ends 586*a*, 586*b*, 588*a*, 588*b* of the first and second fastening portions 452, 454 are not connected to each other. In such embodiments, for example, the article 400 can be a shirt or coat, e.g., a "button-down" shirt or "full-zip" jacket, and the fastening opening 456 of the article 400 can be an opening of the shirt adjacent to an abdomen of a user. In some embodiments, the article 400 can include a fastening opening connecting portion (not shown) connected to the first and second fastening portions 452, 454 disposed within the fastening opening 456 and connected to at least portions of the first and second fastening portions 452, 454. In such embodiments, the fastening opening connecting portion (not shown) can comprise a material having elastomeric properties such that the fastening opening connecting portion can expand when the fastening system 470 is in the loosened configuration (as shown in FIG. 14) and can retract to help align the plurality of apertures 476 of the second fastening portion 454 with the fastening mechanism 472 of the first fastening portion 452.

It is still further contemplated that at least portions of the first and second fastening portions 452, 454 can comprise different materials or have different material arrangements configured to provide flexibility in particular directions about the article 400 relative to the fastening system 470 while preventing the plurality of apertures 476 from deforming or expanding when the fastening system 470 is in the fastened configuration (see FIG. 15). In some embodiments, at least a portion of the first fastening portion 452 adjacent to the fastening mechanism 472 can comprise a first material and at least a portion of the second fastening portion 454 adjacent to the plurality of apertures 476 can comprise a second material having different elastomeric properties than the first material. In some embodiments, a portion of the second fastening portion 454 adjacent to the plurality of apertures 476 can be configured to provide a first level of elasticity in a first direction that is substantially perpendicular to the aperture axis 596*b* and a second level of elasticity, different than the first level of elasticity, in a second direction that is substantially parallel to the aperture axis 596*b*. In such embodiments, the second level of elasticity can be less than the first level of elasticity.

Referring to FIGS. 14 and 15, various components of the example article 400, including one or more components or structures of the fastening system 470, may be formed through additive manufacturing techniques, such as one or more of the additive manufacturing techniques mentioned above. In some embodiments, the fastening mechanism 472 may be 3D printed as a single unitary piece. In other embodiments, at least the inner portion 496 of the fastening member 478 (see FIG. 14) and the inner portions 538 of the plurality of fastening elements 480 may be 3D printed directly onto a surface of the first fastening portion 452. In some embodiments, one or more portions of the fastening member 478 and/or the plurality of fastening elements 480 may be 3D printed with a first material and other portions of the fastening member 478 and/or the plurality of fastening elements 480 may be 3D printed with a second material having different properties than the first material.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications, and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the disclosure are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the disclosure. The exclusive rights to all modifications which come within the scope of the appended claims are reserved.

I claim:

1. A fastening system for an article of footwear, comprising:

an upper comprising an inner layer and an outer layer with a fastening mechanism disposed along the inner layer and a plurality of apertures defined along the outer layer, the fastening mechanism including:

a fastening member being rotatable in a first direction and a second direction, opposite the first direction; and a plurality of fastening elements disposed in a line and spaced from the fastening member, the plurality of fastening elements being operatively connected to the fastening member by a connecting element, wherein each of the plurality of fastening elements correspond with a respective aperture of the plurality of apertures, wherein, when the fastening member is rotated in the first direction, each of the plurality of fastening elements are simultaneously rotated from a first position toward a second position, and wherein the fastening system is configured to be moveable between a loosened configuration, in which each of the fastening elements is in the first position and aligned within each respective aperture of the plurality of apertures, and a tightened configuration, in which each of the fastening elements is in the second position and offset with respect to each respective aperture of the plurality of apertures.

2. The fastening system of claim 1, wherein the connecting element is a wire in connection with the fastening member and each of the plurality of fastening elements.

3. The fastening system of claim 2, wherein the wire includes a first wire connected to the fastening member and to a first side of each of the plurality of fastening elements, and a second wire connected to the fastening member and to a second side of each of the plurality of fastening elements, opposite the first side.

4. The fastening system of claim 2, wherein the wire is a closed loop wire.

5. The fastening system of claim 1, wherein the fastening system is configured such that, when the fastening system is in the loosened configuration, the fastening system defines a first length, and, when the fastening system is in the tightened configuration, the fastening system defines a second length that is less than the first length.

6. The fastening system of claim 1, wherein the connecting element is a substrate arranged along the inner layer of the upper, and the fastening member and the plurality of fastening elements are connected to the substrate.

7. The fastening system of claim 1, wherein each of the plurality of fastening elements has a first portion extending from a first end, a second portion extending from a second end, opposite the first end, and a third portion extending between the first and second portions, and wherein at least the second portions of each of the fastening elements are visible from an exterior of the footwear while worn by a user.

8. The fastening system of claim 7, wherein each of the first portions of the plurality of fastening elements are disposed within a channel compartment and rotatably attached to the inner layer of the upper, and each of the second portions of the plurality of fastening elements extend through a channel opening in the outer layer of the upper.

9. The fastening system of claim 7, wherein at least the third portions of the plurality of fastening elements comprise an elastomeric material.

10. The fastening system of claim 7, wherein each of the apertures of the plurality of apertures has a first geometric shape, and wherein at least the second portion of each of the plurality of fastening elements has an outer perimeter with a second geometric shape that is different than the first geometric shape.

11. The fastening system of claim 7, wherein each of the apertures of the plurality of apertures has a first geometric shape, and wherein at least the second portion of each of the plurality of fastening elements has an outer perimeter with a second geometric shape that is similar to the first geometric shape.

12. The fastening system of claim 1, wherein the plurality of apertures includes a first aperture and a second aperture, wherein the plurality of fastening elements includes a first fastening element and a second fastening element, the first fastening element being arranged adjacent to the first aperture and the second fastening element being arranged adjacent to the second aperture, wherein the first fastening element and the first aperture have a first geometric shape, and the second fastening element and the second aperture have a second geometric shape that is different than the first geometric shape.

13. An article of footwear, comprising:

a sole attached to an upper that includes a first layer and a second layer; and a fastening system, including:

a plurality of apertures arranged along the first layer; and a fastening mechanism including:

a fastening member disposed at least partially along the second layer, the fastening member being rotatable in a first direction and a second direction, opposite the first direction; and a plurality of fastening elements disposed at least partially along the second layer, each of the fastening elements corresponding to a respective aperture of the plurality of apertures; and a connecting element that operatively connects the plurality of fastening elements with the fastening member, wherein, when the fastening member is rotated in the first direction, each of the plurality of fastening elements are simultaneously rotated from a first position toward a second position, and wherein the fastening system is configured to be adjustable between a loosened configuration, in which the plurality of fastening elements is in the first position and aligned within the plurality of apertures, and a tightened configuration, in which the plurality of fastening elements is in the second position and misaligned with the plurality of apertures.

14. The article of footwear of claim 13, wherein the fastening mechanism is arranged on a lateral side or a medial side of the upper.

15. The article of footwear of claim 13, wherein the fastening member has a first geometric shape, and wherein each of the plurality of fastening elements has a second geometric shape that is different than the first geometric shape.

16. The article of footwear of claim 13, wherein the connecting element is visible from an exterior of the footwear while worn by a user.

17. The article of footwear of claim 13, wherein the fastening mechanism is arranged along an instep region of the upper.

18. The article of footwear of claim 17, wherein the fastening system is a first fastening system, the fastening mechanism is a first fastening mechanism, and the plurality of apertures is a first plurality of apertures, wherein the article of footwear further comprises a second fastening system including a second fastening mechanism, and a second plurality of apertures.

19. The article of footwear of claim 18, wherein the upper includes a tongue arranged along the instep region, wherein the first fastening system is arranged to engage a lateral side of the tongue and the second fastening system is arranged to engage a medial side of the tongue, and wherein, when the first and second fastening systems are in the tightened configuration, the tongue is retained adjacent to the upper, and, when the first and second fastening systems are in the loosened configuration, the tongue is moveable relative to the upper.

20. An article, comprising:

an opening comprising a first fastening portion and a second fastening portion configured to be fastened with the first fastening portion to close the opening of the article; and a fastening system including:

a plurality of apertures defined along the second fastening portion and extending at least partially through the second fastening portion; and a fastening mechanism including:

a fastening member being rotatable in a first direction and in a second direction, opposite the first direction; and a plurality of fastening elements disposed in a line and spaced from the fastening member, the plurality of fastening elements being operatively connected to the fastening member by a connecting element, wherein each of the plurality of fastening elements correspond with a respective aperture of the plurality apertures, wherein, when the fastening member is rotated in the first direction, each of the plurality of fastening elements are simultaneously rotated from a first position toward a second position, and wherein the fastening system is configured to be moveable between an unfastened configuration, in which each of the fastening elements is in the first position and aligned within each respective aperture of the plurality of apertures, and a fastened configuration, in which each of the fastening elements is in the second position and offset with respect to each respective aperture of the plurality of apertures.

* * * * *